US010499181B1

(12) United States Patent
Ramalingam

(10) Patent No.: US 10,499,181 B1
(45) Date of Patent: Dec. 3, 2019

(54) OBJECT AUDIO REPRODUCTION USING MINIMALISTIC MOVING SPEAKERS

(71) Applicant: SONY CORPORATION, Tokyo (JP)

(72) Inventor: Prabakaran Ramalingam, Bangalore (IN)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/047,488

(22) Filed: Jul. 27, 2018

(51) Int. Cl.

| | |
|---|---|
| ***H04S 1/00*** | (2006.01) |
| ***H04S 7/00*** | (2006.01) |
| ***H04R 5/02*** | (2006.01) |
| ***H04R 5/04*** | (2006.01) |
| ***H04S 3/00*** | (2006.01) |

(52) U.S. Cl.
CPC ..... *H04S 7/303* (2013.01); *H04R 5/02* (2013.01); *H04R 5/04* (2013.01); *H04S 3/008* (2013.01); *H04S 7/308* (2013.01); *H04S 2400/01* (2013.01); *H04S 2400/11* (2013.01)

(58) Field of Classification Search
CPC .... H04S 2400/11; H04S 2400/01; H04S 5/00; H04S 2420/01; H04S 2420/13; H04S 5/005; H04S 3/00; H04S 7/40; H04S 7/303; H04S 3/008; H04S 7/308; H04R 5/02; H04R 2201/401; H04R 2430/20; H04R 2499/13; H04R 3/12; H04R 5/04
USPC ..... 381/303, 17–18, 306, 307, 310, 58, 59
See application file for complete search history.

(56) References Cited

U.S. PATENT DOCUMENTS

| | | | | |
|---|---|---|---|---|
| 5,181,564 | A | 1/1993 | Lindley et al. | |
| 2009/0022354 | A1* | 1/2009 | Parker | H04R 1/026 381/395 |
| 2015/0208190 | A1* | 7/2015 | Hooks | H04R 1/403 381/303 |
| 2016/0104491 | A1* | 4/2016 | Lee | H04S 3/008 381/22 |

OTHER PUBLICATIONS

Dr. Ir. Edwin Dertien, "Sound Swarm", Experience sound from the inside, University of Twente, Jul. 2017, 88 pages.

* cited by examiner

*Primary Examiner* — Norman Yu
(74) *Attorney, Agent, or Firm* — Chip Law Group

(57) ABSTRACT

Audio reproduction apparatus that includes a memory and a control circuitry. The memory stores an encoded object-based audio stream that includes a plurality of audio frames which include at least one encoded audio object that comprises an audio segment and metadata information. The control circuitry extracts the metadata information and controls movement of a first speaker of a plurality of speakers in a physical three dimensional (3D) space from a first position to a second position at a first time instant, based on the extracted metadata information associated with the at least one encoded audio object. The control circuitry decodes the audio segment from the at least one encoded audio object and controls play back of the decoded audio segment, at a second time instant, by the first speaker at the second position in a first audio frame of the plurality of audio frames.

20 Claims, 11 Drawing Sheets

308

| | Frame 0 | Frame 1 | Frame 2 |
|---|---|---|---|
| Audio Object 306A | 100,20,80 | 100,20,80 | - |
| Audio Object 306B | - | 10,-50,0 | 10,-50,0 |
| Audio Object 306C | - | - | -80,10,5 |

408

| | Frame 0 | Frame 1 | Frame 2 |
|---|---|---|---|
| Audio Object 404A | 10, 100, 50 | 50, 30, 60 | 40, -35, 70 |
| Audio Object 404B | -30, -50, 0 | 10, -50, 0 | 30, -50, 0 |

502

| | | | | | | | | | | | |
|---|---|---|---|---|---|---|---|---|---|---|---|
| X | 5 | 39 | 65 | 88 | 99 | 106 | 100 | 85 | 60 | 40 | 4 |
| Y | 90 | 72 | 53 | 33 | 16 | -7 | -28 | -47 | -66 | -78 | -90 |
| Z | 0 | 0 | 0 | 0 | 0 | 0 | 0 | 0 | 0 | 0 | 0 |

OBJECT AUDIO REPRODUCTION USING MINIMALISTIC MOVING SPEAKERS

REFERENCE

None.

FIELD

Various embodiments of the disclosure relate to audio reproduction technologies. More specifically, various embodiments of the disclosure relate to an apparatus and a method to reproduce an object-based audio stream using minimalistic moving speakers.

BACKGROUND

Recent advancements in the field of audio reproduction have led to development of various technologies and systems related to surround sound generation in different enclosures, such as rooms and cinema halls. One of such systems is a multi-channel audio reproduction system, which is also referred to as a surround sound system. The surround sound system have multiple speakers, each of which produces an audio provided on a respective channel. However, such surround audio systems have speakers that are placed on fixed positions in a listening area. Thus, reproduction of sound for different audio objects in an object-based audio stream from a conventional surround sound system may not provide accurate and realistic sound reproduction. The object-based audio stream may be audio content in which different audio are decomposed into distinct objects. These objects, known as audio objects, also define sound sources, and include audio signals and some metadata that indicates position of the sound source at the time of recording of sound etc. Now-a-days, such object-based audio representations and related audio technology is an active area of research. Typically, to provide the accurate audio reproduction of the object-based audio stream, which may include the audio objects that are captured at different positions in an actual 3D space, a substantial number of speakers may be required for audio reproduction in every possible position in X, Y, Z directions in a listening area, such a room. This may not be practically feasible and may further led to excessive cost and complexity of the audio systems, which may be undesirable.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

An apparatus and method for reproducing audio objects in an object-based audio stream using minimalistic moving speakers is provided substantially as shown in, and/or described in connection with, at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

The following described implementations may be found in the disclosed apparatus for reproducing audio objects included in an object-based audio stream using minimalistic moving speakers. Exemplary aspects of the disclosure provide an audio reproduction apparatus which provides an enhanced surround sound experience to a listener by controlling movement of only minimum number of speakers in a physical 3D space that is required to create such enhanced surround sound experience.

The audio reproduction apparatus may include a memory configured to store an encoded object-based audio stream which includes a plurality of audio frames. The plurality of audio frames may include at least one encoded audio object that further includes an audio segment and metadata information associated with the at least one encoded audio object. The metadata information may comprise position information of each audio object. The position information may be encoded with the audio object. The position information associated with the audio object may indicate a spatial position of a sound source at the time of capture of sound in a real 3D environment, which may be desired to be reproduced in the physical 3D space, such as a room, using minimum number of speakers from a plurality of speakers provided in the physical 3D space. The disclosed audio reproduction apparatus enables controlled movement of one or more speakers of the plurality of speakers in the physical 3D space. The controlled movement may be based on the position information of the audio objects and before the actual reproduction of sound of the audio objects. A speaker that may be present in the physical 3D space nearest to a position of the audio object, may be moved, while other speakers may not be moved or may be assigned for other audio objects. With the controlled movement of speakers in the physical 3D space based on the position information of the audio objects, the disclosed audio reproduction apparatus may be able to accurately reproduce sound of the audio objects without increasing the number of speakers for a particular task, and corresponding cost and complexity. Thus, the disclosed audio reproduction apparatus provides a cost-effective, accurate, and enhanced surround sound effect to a listener in a physical 3D space, such as a room, similar to a real 3D environment (excluding unwanted noise) at which the audio objects were recorded or captured in the real 3D environment.

Figure 1:
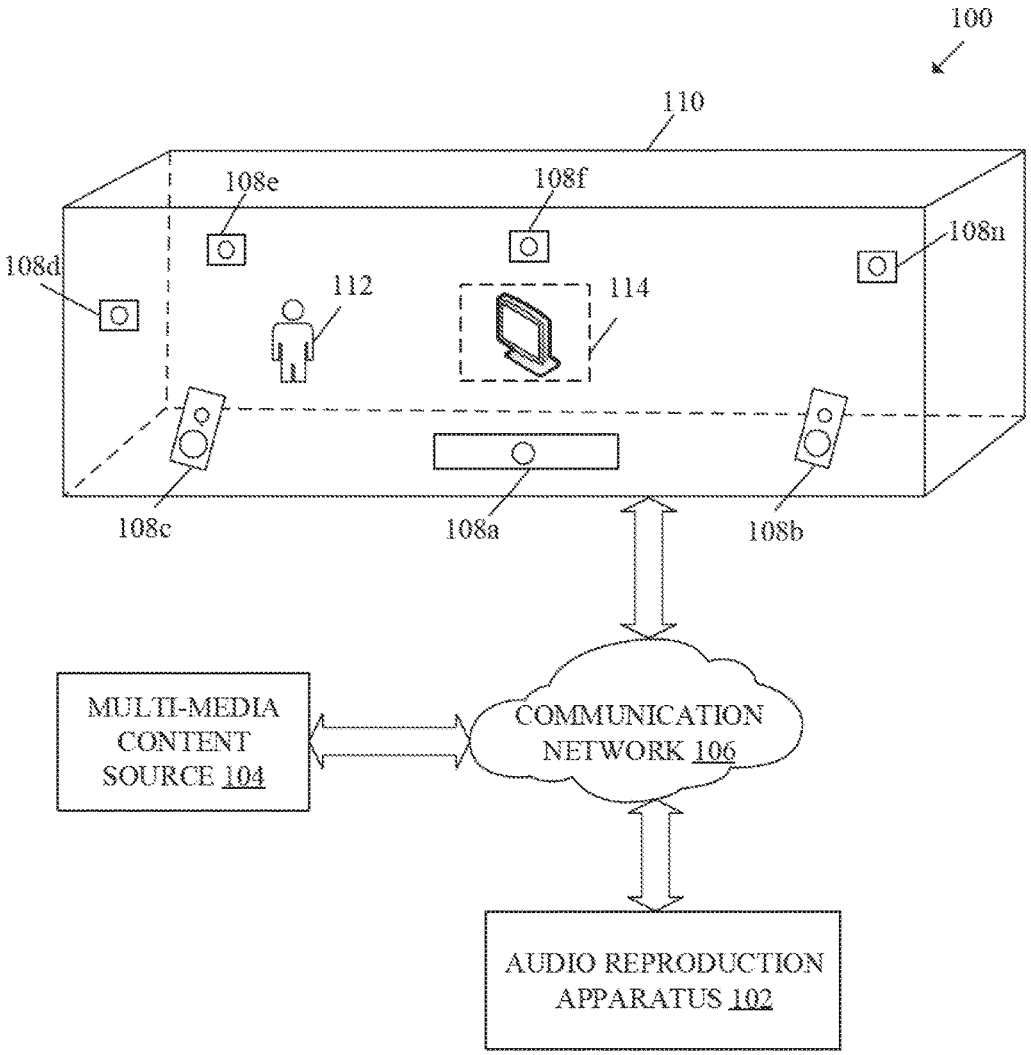
FIG. 1 is a block diagram that illustrates an exemplary network environment for reproducing audio objects, included in an object-based audio stream, using minimalistic moving speakers, in accordance with an embodiment of the disclosure.

FIG. 1 is a block diagram that illustrates an exemplary network environment for reproducing audio objects, included in an object-based audio stream, using minimalistic moving speakers, in accordance with an embodiment of the disclosure. With reference to FIG. 1, there is shown a network environment 100. The network environment 100 may include an audio reproduction apparatus 102, a multi-media content source 104, a communication network 106, a plurality of speakers 108*a* to 108*n*, a listening area 110, and a listener 112. The audio reproduction apparatus 102 may be communicatively coupled to the multi-media content source 104 and the plurality of speakers 108*a* to 108*n* via the communication network 106.

The audio reproduction apparatus 102 may comprise suitable logic, circuitry, and interfaces that may be configured to control the plurality of speakers 108*a* to 108*n* to move in a physical 3D space (i.e. the listening area 110) from a first position to a second position. The audio reproduction apparatus 102 may configured to control the movement of the plurality of speakers 108*a* to 108*n* based on position information of audio objects in an encoded object-based audio stream. The encoded object-based audio stream may include a plurality of audio frames, each of which includes an audio object. The audio object may include an audio segment and the position information of an audio source associated with the audio segment. The position information may indicate a XYZ position of the audio source at the time of capture or creation of the encoded object-based audio stream.

The audio reproduction apparatus 102 may be further configured to control the plurality of speakers 108*a* to 108*n* (which were moved in the physical 3D space to the second position) to play back the audio objects of the encoded object-based audio stream. In some embodiments, the audio reproduction apparatus 102 may be display device or a television 114 which renders the multi-media content including the encoded object-based audio stream to the listener 112. Examples of the audio reproduction apparatus 102 may include, but are not limited to, a multi-channel speaker system, an audio-video (AV) entertainment system, a home theatre system, a television system, a display system, video-conferencing system, a computing device, a gaming device, a mainframe machine, a server, a computer work-station, and/or a consumer electronic (CE) device.

The multi-media content source 104 may comprise suitable logic, circuitry, and interfaces that may be configured to store multi-media content, such as the encoded object-based audio stream. In some embodiments, the multi-media content source 104 may be further configured to generate the encoded object-based audio stream by encoding an audio data of the audio source with metadata information that include the position information of the audio source. The multi-media content source 104 may be further configured to communicate the multi-media content including the encoded object-based audio stream to the audio reproduction apparatus 102, via the communication network 106. In some embodiments, the multi-media content source 104 may be a server that stores the multi-media content. Examples of the server may include, but is not limited to a cloud server, a database server, a file server, a web server, an application server, a mainframe server, or other types of server. In some embodiments, the multi-media content source 104 may be a set top box, a live content streaming device, or a broadcast station. Examples of the multi-media content may include, but are not limited to, audio content, video content, television content, animation content, and/or interactive content.

The communication network 106 may include a communication medium through which the audio reproduction apparatus 102 may be communicatively coupled to the multi-media content source 104 and the plurality of speakers 108*a* to 108*n* enclosed in the physical 3D space, such as the listening area 110. Examples of the communication network 106 may include, but are not limited to, the Internet, a cloud network, a Wireless Fidelity (Wi-Fi) network, a Personal Area Network (PAN), a Local Area Network (LAN), or a Metropolitan Area Network (MAN). Various devices in the network environment 100 may be configured to connect to the communication network 106, in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), Zig Bee, EDGE, IEEE 802.11, light fidelity (Li-Fi), 802.16, IEEE 802.11s, IEEE 802.11g, multi-hop communication, wireless access point (AP), device to device communication, cellular communication protocols, and Bluetooth (BT) communication protocols.

The plurality of speakers 108*a* to 108*n* may comprise suitable logic, circuitry, and interfaces that may be configured to receive an audio signal from the audio reproduction apparatus 102, via the communication network 106. Each of the plurality of speakers 108*a* to 108*n* may be further configured to output or play back sound based on the received audio signal. In some embodiments, the plurality of speakers 108*a* to 108*n* may be communicatively coupled to the audio reproduction apparatus 102, via a wired or a wireless network. Each of the plurality of speakers 108*a* to 108*n* may be initially positioned at a particular location, for example, default locations, in the listening area 110 to create a surround-sound listening environment. The locations of each of the plurality of speakers 108*a* to 108*n* may be known to the audio reproduction apparatus 102. In accordance with an embodiment, each of the plurality of speakers 108*a* to 108*n* are further configured to receive the position information along with the audio signal from the audio reproduction apparatus 102. Each of the plurality of speakers 108*a* to 108*n* are further configured to extract the X-axis, Y-axis, and Z-axis coordinates (hereinafter, referred to as XYZ coordinates) from the received position information, and accordingly move in the physical 3D space, such as the listening area 110, based on the extracted XYZ coordinates.

In accordance with an embodiment, the plurality of speakers 108*a* to 108*n* may be further configured to reproduce multi-channel audio based on determined locations and/or configurations of the plurality of speakers 108*a* to 108*n* within the listening area 110. Examples of the multi-channel speaker systems may include, but are not limited to, 2.1, 5.1, 7.1, 9.1, 11.1, etc, speaker system arrangements. In accordance with an embodiment, the speaker 108*a* may correspond to a central speaker, while the plurality of speakers 108*b* to 108*n* may correspond to one or more surround speakers in the listening area 110. Examples of the plurality of speakers 108*a* to 108*n* may include, but are not limited to, a loudspeaker, a woofer, a sub-woofer, a tweeter, a wireless speaker, a monitor speaker, or other speakers or sound output devices.

The listening area 110 may refer to a physical 3D area in which different audio items are reproduced through the plurality of speakers 108*a* to 108*n*. Examples of the listening area 110 may include, but are not limited to a physical space within a building (such as an enclosed residential space, a movie theater, a conference area, and the like), or a combination of the open space and built architectures (e.g., a stadium, an outdoor musical event, a park, a playground, and the like).

The listener 112 may refer to an object-of-interest who consumes the surround sound produced by the plurality of speakers 108*a* to 108*n*. The listener 112 may be a human or a robot that may resemble a real human. The listener 112 may be associated with the audio reproduction apparatus 102.

In operation, the audio reproduction apparatus 102 may be configured to store an encoded object-based audio stream which includes a plurality of audio frames. Each of the plurality of audio frames may include at least one encoded audio object. The encoded audio object may include an audio segment and metadata information (e.g., (position information) associated with the encoded audio object. The metadata information of the audio object may include a XYZ coordinate to indicate a position of the audio source of the audio segment in a 3D real space (or real environment). In some embodiments, the audio reproduction apparatus 102 may be further configured to receive the encoded object-based audio stream from the multi-media content source 104, via the communication network 106.

In accordance with an embodiment, the audio reproduction apparatus 102 may be further configured to extract (pre-decode) the metadata information (the position information) for each audio object in each of the plurality of audio frames in the encoded object-based audio stream. The audio reproduction apparatus 102 may be configured to control movement of the plurality of speakers 108*a* to 108*n* in the physical 3D space, such as the listening area 110, based on the extracted position information for each audio object in different audio frames. In accordance with an embodiment, the audio reproduction apparatus 102 may be configured to control movement of the plurality of speakers 108*a* to 108*n* in a linear path or in a curve trajectory. The audio reproduction apparatus 102 may be configured to movement of at least one speaker of the plurality of speakers 108*a* to 108*n* in a defined trajectory, based on an identification of the audio object moving in the defined trajectory for a number of consecutive audio frames in the object-based audio stream.

In accordance with an embodiment, the audio reproduction apparatus 102 may be configured to control movement of the at least one speaker (of the plurality of speaker 108*a* to 108*n*) from a starting position to a destination position during the reproduction of at least one audio frame. The audio reproduction apparatus 102 may be configured to control movement of the at least one speaker based on the position information of the audio object of an upcoming audio frame in the object-based audio stream. Thus, at least one speaker is moved to a desired location in the physical 3D space (such as the listening area 110) before rendering (or reproduction of) of the audio segment of the audio object included in the upcoming audio frame.

In accordance with an embodiment, the audio reproduction apparatus 102 may be configured to decode audio segments from the audio objects in the plurality of audio frames. The audio reproduction apparatus 102 may be further configured to control the plurality of speakers 108*a* to 108*n* in the listening area 110 based on the extracted position information) to play back the sound of the decoded audio segments of the audio objects in different audio frames. The movement of the plurality of speakers 108*a* to 108*n* based on the position information of the audio objects and further rendering of the sound of the audio objects by the plurality of speakers 108*a* to 108*n* is described in detail, for example, in FIGS. 3A to 3D.

In accordance with an embodiment, each of the plurality of speakers 108*a* to 108*n* may be mounted on a movable device with capability to move in the XY positions. In some embodiments, each of the plurality of speakers 108*a* to 108*n* may be mounted on a flying object (e.g. drone) with capability to move in XYZ positions in the physical 3D space (such as the listening area 110). In some embodiments, the plurality of speakers 108*a* to 108*n* may be mounted on a plurality of movable arms of a device installed inside the listening area 110. The device may be fixed to either of ceiling, floor or walls of the listening area 110. The plurality of movable arms of the device may move in the listening area 110 based on control signals sent from the audio reproduction apparatus 102. In some embodiments, the plurality of speakers 108*a* to 108*n* may be mounted on an electronic or a mechanical device with a capability to move in 360-degree directions in the physical 3D space. Thus, with the capability of the plurality of speakers 108*a* to 108*n* to move in different XYZ positions in the physical 3D space (such as listening area 110), the listener 112 may experience an enhanced surround sound experience similar to the positioning of different audio sources at the time of capture of sound for the audio objects included in the encoded object-based audio stream. The capability of the plurality of speakers 108*a* to 108*n* to move in the physical 3D space (such as listening area 110) under the control of the audio reproduction apparatus 102 provides the functionality to mimic 3D positioning of the audio objects in the object-based audio stream to the 3D position (XYZ coordinates) of the speakers 108*a* to 108*n* in the physical 3D space (i.e. listening area 110). Thus, a true immersive and surround sound effect may be provided to a listener, such as the listener 112, in the physical 3D space (i.e. listening area 110).

Figure 2:
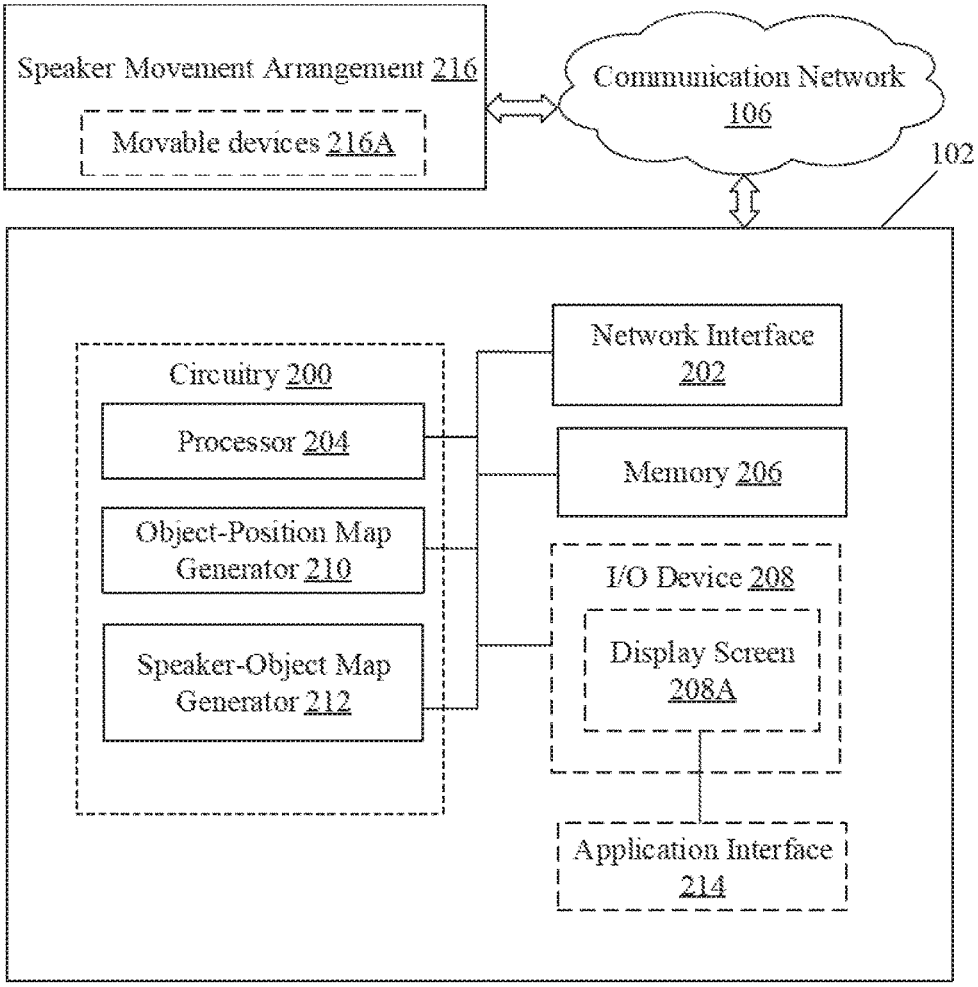
FIG. 2 is a block diagram that illustrates an exemplary audio reproduction apparatus for reproducing audio objects, included in the object-based audio stream, using minimalistic moving speakers, in accordance with an embodiment of the disclosure.

FIG. 2 is a block diagram that illustrates an exemplary audio reproduction apparatus for reproducing audio objects, included in the object-based audio stream, using minimalistic moving speakers, in accordance with an embodiment of the disclosure. FIG. 2 is explained in conjunction with elements from FIG. 1. With reference to FIG. 2, there is shown a block diagram of the audio reproduction apparatus 102. The audio reproduction apparatus 102 may include circuitry 200, a network interface 202, a memory 206, and an Input/output (I/O) device 208. The circuitry 200 may further include a processor 204, an object-position map generator 210, and a speaker-object map generator 212. The I/O device 208 may include a display screen 208A. An application interface 214 may be rendered on the display screen 208A. There is also shown a speaker movement arrangement 216 that may include a plurality of movable devices, such as movable devices 216A. The circuitry 200 may be communicatively coupled with the network interface 202, the memory 206, the I/O device 208, via a set of communication ports/channels.

The network interface 202 may comprise suitable logic, circuitry, and interfaces that may be configured to communicate control signals to control movement of the plurality of speakers 108*a* to 108*n*, via the communication network 106. The network interface 202 may be further configured to communicate audio signals to the plurality of speakers 108*a* to 108*n* for play back, via the communication network 106. The network interface 202 may be further configured to receive one or more encoded object-based audio streams from the multi-media content source 104, via the communication network 106. The network interface 202 may be implemented by use of various known technologies to support wired or wireless communication of the audio reproduction apparatus 102 with the communication network 106. The network interface 202 may communicate via various wired or wireless communication protocols. The network interface 202 may include, but is not limited to, an antenna, a radio frequency (RF) transceiver, one or more amplifiers, a tuner, one or more oscillators, a digital signal processor, a coder-decoder (CODEC) chipset, a subscriber identity module (SIM) card, and a local buffer.

The processor 204 may comprise suitable logic, circuitry, and interfaces that may be configured to execute a set of instructions stored in the memory 206. In some embodiments, the processor 204 may be configured to receive the encoded object-based audio stream from the multi-media content source 104, via the network interface 202. The processor 204 may be configured to decode the encoded object-based audio stream stored in the memory 206. The processor 204 may be further configured to extract (pre-decode) the metadata information (position information) of the audio objects included in each of the plurality of audio frames of the encoded object-based audio stream. The processor 204 may be further configured to control the plurality of speakers 108*a* to 108*n* to move (linearly or in a trajectory) in the physical 3D space (i.e. listening area 110) based on the extracted position information (XYZ coordinates) before the reproduction of the audio objects. The processor 204 may be implemented based on a number of processor technologies known in the art. Examples of the processor 204 may include, but are not limited to, a Graphical Processing Unit (GPU), a Central Processing Unit (CPU), an x86-based processor, an x64-based processor, a Reduced Instruction Set Computing (RISC) processor, an Application-Specific Integrated Circuit (ASIC) processor, a Complex Instruction Set Computing (CISC) processor.

The memory 206 may comprise suitable logic, circuitry, and interfaces that may be configured to store a set of instructions executable by the processor 204. The memory 206 may be configured to store a plurality of encoded object-based audio streams. In some embodiments, the memory 206 may be configured to store multi-media content that includes encoded object-based audio stream. Examples of implementation of the memory 206 may include, but are not limited to, Random Access Memory (RAM), Read Only Memory (ROM), Electrically Erasable Programmable Read-Only Memory (EEPROM), Hard Disk Drive (HDD), a Solid-State Drive (SSD), a CPU cache, or a Secure Digital (SD) card.

The I/O device 208 may comprise suitable logic, circuitry, and interfaces that may be configured to provide an I/O channel/interface between the listener 112 and the different operational components of the audio reproduction apparatus 102. The I/O device 208 may receive an input from a user, such as the listener 112, and present an output based on the provided input from the user. The I/O device 208 may include various input and output ports to connect various other I/O devices that may communicate with different operational components of the audio reproduction apparatus 102. Examples of the input device may include, but are not limited to, a touch screen, a keyboard/keypad, a set of buttons, a mouse, a joystick, a microphone, and an image-capture device. Examples of the output device may include, but are not limited to, a display (for example, the display screen 208A), a speaker, and a haptic or any sensory output device.

The display screen 208A may comprise suitable logic, circuitry, interfaces that may be configured to render the application interface 214 at the display screen 208A, to display information to the listener 112 who may operate the audio reproduction apparatus 102. The display screen 208A may be configured to display the multi-media content including visual information (i.e. image or video). The display screen 208A may be realized through several known technologies such as, but not limited to, at least one of a Liquid Crystal Display (LCD) display, a Light Emitting Diode (LED) display, a plasma display, and an Organic LED (OLED) display technology, and other display. In accordance with an embodiment, the display screen 208A may refer to a display screen of a smart-glass device, a see-through display, a projection-based display, an electro-chromic display, and a transparent display.

The object-position map generator 210 may comprise suitable logic, circuitry, and/or interfaces that may be configured to receive, from the processor 204, the metadata information for each audio object included in the encoded object-based audio stream. The object-position map generator 210 may be further configured to generate a mapping between each audio object included in the object-based audio stream and the extracted position information of the corresponding audio object. The position information (XYZ coordinates) indicates the exact position information (in a 3D space) of each audio object when an audio of the corresponding audio object was captured or recorded. In accordance with an embodiment, the processor 204 may be configured to control the movement of a set of speakers of the plurality of speaker 108*a* to 108*n* to the same XYZ positions (that were extracted from the audio objects) and further control the play back the audio of the audio objects. The play back of audio is executed whenever the audio frames of the audio objects arrive for sound reproduction in the object-based audio stream. In accordance with an embodiment, the audio reproduction apparatus 102 may be configured to control the movement of the plurality of speaker 108*a* to 108*n* based on the object-position mapping generated by the object-position map generator 210. In some embodiments, the object-position map generator 210 may be implemented as a specialized/special-purpose circuitry. Other examples of implementations of the object-position map generator 210 may be a Graphics Processing Unit (GPU), a Reduced Instruction Set Computing (RISC) processor, an Application-Specific Integrated Circuit (ASIC) processor, a Complex Instruction Set Computing (CISC) processor, a microcontroller, a central processing unit (CPU), or other control circuits.

The speaker-object map generator 212 may comprise suitable logic, circuitry, and/or interfaces that may be configured to generate a speaker-object mapping between each audio object included in the object-based audio stream and the plurality of speakers 108*a* to 108*n*. The speaker-object mapping generated by the speaker-object map generator 212 indicates which speakers of the plurality of speakers 108*a* to

108*n* are controlled by the processor 204 to be moved in the physical 3D space (i.e. listening area 110) and further play back the sound of the corresponding audio objects. In accordance with an embodiment, the processor 204 may be configured to select or assign a set of speakers from the available plurality of speakers 108*a* to 108*n* (in the listening area 110) to a particular upcoming audio object based on the speaker-object mapping generated by the speaker-object map generator 212. The processor 204 may be further configured to control movement of the selected set of speakers based on the position information of the particular upcoming audio object indicated by the speaker-object mapping generated by the object-position map generator 210. In some embodiment, the processor 204 may be configured to select or assign the set of speakers which are nearest, among the plurality of speakers 108*a* to 108*n*, to reach (or move) to a particular position in the physical 3D space (i.e. listening area 110) in accordance with the position information of the particular upcoming audio object. In accordance with an embodiment, the speaker-object mapping generated by the speaker-object map generator 212 may indicate an operation mode of the plurality of speaker 108*a* to 108*n*. Examples of the operation mode may include, but are not limited to, active mode (speaker producing sound but not in motion), motion mode (speaker in motion either linearly or in trajectory but not producing sound while in motion), active motion mode (speaker producing sound as well as in motion), inactive mode (speaker is idle, not producing sound, and not in motion). Examples of implementations of the speaker-object map generator 212 may be a specialized circuitry, a Graphics Processing Unit (GPU), a Reduced Instruction Set Computing (RISC) processor, an Application-Specific Integrated Circuit (ASIC) processor, a Complex Instruction Set Computing (CISC) processor, a microcontroller, a central processing unit (CPU), or other control circuits.

The application interface 214 may correspond to a user interface (UI) rendered on a display screen, such as the display screen 208A. The application interface 214 may be configured to display a video portion of the multi-media content including the encoded object-based audio stream. In some embodiments, the application interface 214 may be configured to display UI options through user input which may be received for the audio reproduction apparatus 102. Examples of the user input may include, but are not limited to, search or selection of content from the multi-media content source 104 or from the memory 206, configuration of settings of the audio reproduction apparatus 102, selection of a source of the multi-media content, selection of a particular audio frame for rendering, activation/deactivation of particular speaker from the plurality of speaker 108*a* to 108*n*, and/or a user-defined or manual control of the movement of the plurality of speaker 108*a* to 108*n*.

The speaker movement arrangement 216 may correspond to a structure that provides a support to hold the plurality of speakers 108*a* to 108*n* in the 3D physical space (such as the listening area 110). The structure of the speaker movement arrangement 216 may change in the real-time based on positional change of at least one speaker of the plurality of speakers 108*a* to 108*n*. In some embodiments, the speaker movement arrangement 216 may include a plurality of movable devices 216A. The plurality of speakers 108*a* to 108*n* are mounted or mechanically attached on the plurality of movable devices 216A. The plurality of movable devices 216A may have the capability to move in XYZ positions in the physical 3D space (i.e. listening area 110). The speaker movement arrangement 216 may include tracks on the walls (or ceiling or floor) of the listening area 110. The movable devices 216A may move on the tracks of the speaker movement arrangement 216 to position the plurality of speakers 108*a* to 108*n* at different XYZ positions. In accordance with an embodiment, the speaker movement arrangement 216 may be configured to receive control signals from the audio reproduction apparatus 102, via the communication network 106. The speaker movement arrangement 216 may be configured to control the movement of the movable devices 216A based on the received control signals. In some embodiments, the plurality of speakers 108*a* to 108*n* may be movable speakers and may have the capability to move in the physical 3D space (i.e. listening area 110) itself based on the control signals directly received from the audio reproduction apparatus 102.

The functions or operations executed by the audio reproduction apparatus 102, as described in FIG. 1, may be performed by the circuitry 200, the processor 204, the object-position map generator 210, and the speaker-object map generator 212. The operations executed by the processor 204, the object-position map generator 210, and the speaker-object map generator 212 are further described, for example, in the FIGS. 3A to 3D and 4A to 4D.

Figures 3A, 3B:
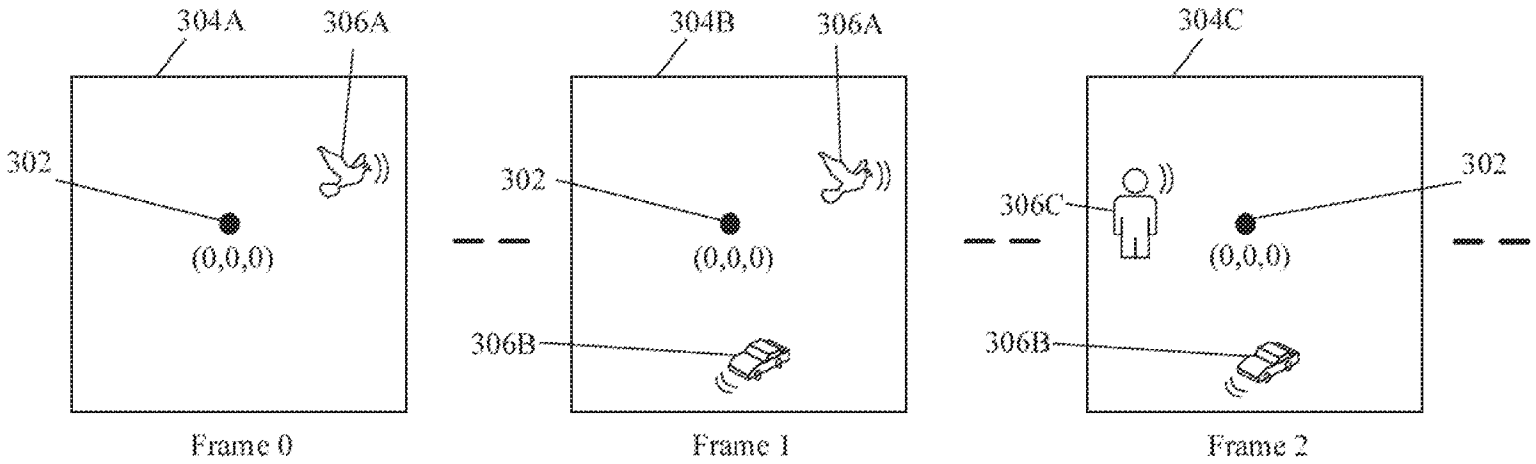
FIG. 3A, FIG. 3B, FIG. 3C, and FIG. 3D collectively, illustrate exemplary operations for reproducing audio objects using minimalistic moving speakers by the audio reproduction apparatus of FIG. 2, in accordance with an embodiment of the disclosure.

FIG. 3A, FIG. 3B, FIG. 3C, and FIG. 3D, collectively, illustrate exemplary operations for reproducing audio objects using minimalistic moving speakers by the audio reproduction apparatus of FIG. 2, in accordance with an embodiment of the disclosure. FIGS. 3A, 3B, 3C, and 3D are explained in conjunction with elements from FIGS. 1 and 2. FIG. 3A illustrates frame-by-frame representation of the audio objects included in the encoded object-based audio stream, in accordance with an embodiment of the disclosure. With reference to FIG. 3A, there is shown different consecutive frames 304A, 304B, and 304C (as frame 0, frame 1, and frame 2) of the plurality of audio frames of the object-based audio stream. In some embodiments, the object-based audio stream may correspond to audio content which includes the plurality of audio frames. An audio frame may be a representative frame to indicate 3D positioning of each audio object with respect to each other. For example, each of the audio frames (such as the first frame 304A, the second frame 304B, and the third frame 304C in FIG. 3A depicts a relative positioning of the audio objects 306A, 306B, and 306C with respect to each other and the center position 302. The total number audio frames in the object-based audio stream may be based on certain factors. Examples of such factors may include, but are not limited to, sampling rate (i.e. frames per second) at which the plurality of audio frames were recorded, total time or length of the object-based audio, and/or size of the object-based audio stream. In accordance with an embodiment, the coordinates of the center position 302 may be 0,0,0. In some embodiments, the center position 302 may correspond a position of an audio or video capturing device, which captured sound related to the audio object with the corresponding position information of the audio object, and accordingly created the encoded object-based audio stream.

With reference to FIGS. 3A and 3B, a first frame 304A (also represented as frame 0) may include a first audio object 306A (say a flying bird) with the position information in XYZ coordinates, for example, represented as: 100, 20, 80 (in FIG. 3B). In an accordance with an embodiment, the XYZ coordinates may be indicated in different units of lengths measured from the center position 302. Examples of the units of length may include, but not limited to, are millimeter (mm), centimeter (cm), inches, feet, yard, and/or meters (m). In accordance with an embodiment, a second frame 304B (also represented as frame 1) may include two audio objects as the first audio object 306A (as flying bird) and a second audio object 306B (say a vehicle) with corresponding position information in XYZ coordinates, for example, represented as: 10, −50, 0. Similarly, a third frame 304C (also represented as frame 2), shown in FIG. 3A, may include two audio objects as the second audio object 306B (e.g., a vehicle sound) and a third audio object 306C (say voice of a human being) with corresponding position information in XYZ coordinates, for example, represented as: −80, −10, 5. The third frame 304C (also represented as frame 2) may not include the first audio object 306A. In accordance with an embodiment, the exclusion of the first audio object 306A in the third frame 304C (also represented as frame 2) may indicate that the first audio object 306A was not producing the sound during the sound recording of the third frame 304C (also represented as frame 2). In some embodiments, the exclusion of the first audio object 306A in the third frame 304C (also represented as frame 2) may indicate that the sound produced by the first audio object 306A is below a predefined threshold (set by the audio capturing device) during the sound recording of third frame 304C (also represented as frame 2).

In FIG. 3B, an exemplary object-position mapping information is shown generated by the object-position map generator 210 for the plurality of audio frames included in the encoded object-based audio stream. In accordance with an embodiment, the object-position map generator 210 may be configured to generate the object-position mapping information which may indicate the relation between each of the audio objects 306A, 306B, and 306C and the associated position information for each of the plurality of audio frames (such as the first frame 304A, the second frame 304B, and the third frame 304C as shown in FIG. 3A). The position information for each audio object 306A, 306B, and 306C in the object-position mapping information may indicate exact position information (XYZ coordinates) of the audio objects 306A, 306B, and 306C captured/recorded in the audio frames (such as the first frame 304A, the second frame 304B, and the third frame 304C). The generated object-position mapping information for each audio frame may be utilized by the audio reproduction apparatus 102 to automatically control selection and movement of at least one speaker (of the plurality of speakers 108*a* to 108*n*) in advance to a desired position (i.e. position information of target audio object) before controlling the same speaker to output the audio (or sound) of the target audio object during play back of sound related to the corresponding audio frame.

In accordance with an embodiment, the object-position mapping information may also indicate the presence of different audio objects and the associated position information for each of the plurality of audio frames. FIG. 3B illustrates a tabular representation 308 of the object-position mapping information between different audio objects (306A, 306B, and 306C) and the corresponding position information for each of the audio frames (304A, 304B, and 304C). In accordance with an embodiment, an absence (represented a short dash "-") of the position information of the second audio object 306B and the third audio object 306C for the frame '0' 304A may indicate that the second audio object 306B and the third audio object 306C are absent or silent in the first frame 304A (also represented as frame 0). Similarly, an absence of the position information of the first audio object 306A for the third frame 304C (also represented as frame 2) may indicate that the first audio object 306A is absent or silent during the sound recording in the third frame 304C (also represented as frame 2).

Figure 3C:
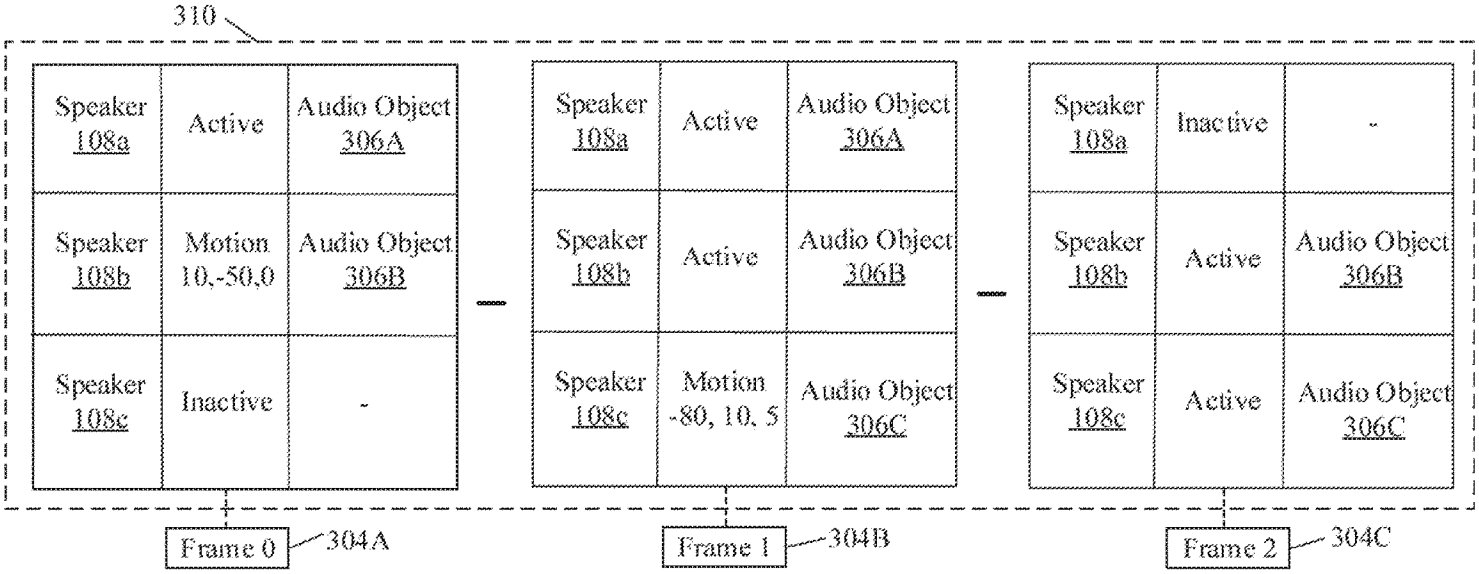

With reference to FIG. 3C, there is shown a tabular representation 310 of speaker-object mapping information generated by the speaker-object map generator 212. The speaker-object mapping information indicates a mapping between a speaker and a corresponding audio object for each audio frame based on the object-position mapping information generated by the object-position map generator 210. In accordance with an embodiment, the speaker-object map generator 212 may be configured to receive the object-position mapping information from the object-position map generator 210 to further generate the speaker-object mapping information. The speaker-object map generator 212 may be further configured to assign at least one speaker (from the plurality of speakers 108*a* to 108*n*) to each audio object in each of the audio frames based on the position information in the object-position mapping information generated by the object-position map generator 210. In accordance with an embodiment, the processor 204 may be configured to store current positions of the plurality of speakers 108*a* to 108*n* (located in the listening area 110) in the memory 206. In some embodiments, the processor 204 may be configured to update current positions of the plurality of speakers 108*a* to 108*n* in the memory 206 after the movement of one or more speakers in the listening area 110. In some embodiments, the processor 204 may be configured to assign a dedicated storage sector in the memory 206 to store the current position of the speaker. The processor 204 may be further configured to update the current position in the dedicated storage sector after the movement of the speaker.

In accordance with an embodiment, the speaker-object map generator 212 may be configured to assign some of the plurality of speakers 108*a* to 108*n* to the audio objects 306A, 306B, and 306C based on the current position of the plurality of speakers 108*a* to 108*n* and the position information of the audio objects (306A, 306B, and 306C). In some embodiments, the speaker-object map generator 212 may be configured to assign or select the speaker (from the plurality of speakers 108*a* to 108*n*) which is nearest to the position information of a particular audio object in the physical 3D space (i.e. listening area 110). In some embodiments, the speaker-object map generator 212 may be configured to assign some of the plurality of speakers 108*a* to 108*n* to the audio objects 306A, 306B, and 306C based on predefined settings. The speaker-object map generator 212 may be configured to assign a speaker to a particular audio object based on a type of audio in the particular audio object. In accordance with an embodiment, the speaker-object map generator 212 may be configured to assign the speaker to the particular audio object based on user inputs. Examples of the user inputs may include, but are not limited to, a specific time interval in the object-based audio stream, a size or an area of the listening area 110, floor-plan information of the listening area 110, material of walls of the listening area 110, occupancy information (number of audio objects or number of non-living items) of the listening area 110, power consumption information of speakers, remaining-battery information of the audio reproduction apparatus 102, remaining-battery information of the plurality of speakers 108*a* to 108*n*.

For example, the audio reproduction apparatus 102 may be configured to assign the speakers 108*a* and 108*b* to a particular audio frame which includes multiple audio objects. In some embodiments, the audio reproduction apparatus 102 may be configured to assign minimum number of available speakers in the listening area 110 based on a number of the audio objects present either in an upcoming audio frame or during an time interval including multiple upcoming consecutive audio frames. In such scenario, the minimum number of available speakers assigned for the time interval may be assigned with the operation mode as the active mode.

As shown in FIG. 3C, the tabular representation 310 of the speaker-object mapping information indicates the assignment of the different speakers (108*a* to 108*c*) to different audio objects (306A, 306B, 306C) in consecutive audio frames (312A, 312B, 312C). The speaker-object mapping information of the first frame 312A (also represented as frame 0) indicates that a first speaker 108*a* is assigned to the first audio object 306A and the second speaker 108*b* is assigned to the second audio object 306B for the first frame 312A (also represented as frame 0). Similarly, the speaker-object mapping information of the second frame 312B (also represented as frame 1) indicates that the first speaker 108*a* is assigned to the first audio object 306A, the second speaker 108*b* is assigned to the second audio object 306B, and a third speaker 108*c* is assigned to the third audio object 306C. Similarly, the speaker-object mapping information of the third frame 312C (also represented as frame 2) indicates that the second speaker 108*b* is assigned to the second audio object 306B, and the third speaker 108*c* is assigned to the third audio object 306C. In accordance with an embodiment, the speaker-object map generator 212 may be configured to assign multiple speakers to a single audio object based on the position information of the audio object. In some embodiments, the multiple speakers which are equidistant in the physical 3D space (i.e. listening area 110) from the position information of the audio object may be assigned to the audio object.

In accordance with an embodiment, the speaker-object mapping information may include operation mode information for each speaker assigned to different audio objects for each audio frame (such as the first frame 312A, the second frame 312B, and the third frame 312C). In accordance with an embodiment, the operation mode information may include different operation modes of the plurality of speakers 108*a*, 108*b*, and 108*c*. Examples of the operation modes may include, but not limited to an active mode, a motion mode, an active motion mode, and inactive mode. The active mode may indicate that the assigned speaker is currently rendering the sound of the audio object for a particular audio frame. The motion mode may indicate that the assigned speaker is moving towards the position information associated with an audio object during play back of a particular audio frame. In some embodiments, the assigned speaker may be in the motion mode for number of consecutive audio frames considering that the position information of the associated audio object is far from the current position of the speaker and the distance between the speaker and the position information cannot be possibly covered by the assigned speaker in one audio frame.

In accordance with an embodiment, the active motion mode may further indicate that the assigned speaker is moving as per the position information of the audio object and at the same time producing the sound of the audio object. In certain scenarios, where the audio object (say a vehicle) produces sound while travelling a path (or trajectory), the assigned speaker may work in the active motion mode during play back of one audio frame or during play back of a plurality of consecutive audio frame so that the listener 112 may hear the actual sound in different positions similar to the sound which was produced by the audio source of the audio object at the time of sound recording. Such rendering of the sound by different speakers (moving through the defined path, curve or trajectory in two and/or three directions or dimensions) produces an immersive and precise sound reproduction for each audio frame, which may be difficult in a traditional scenario where the speakers are located at the fixed positions in the listening area 110. Therefore, the ability of the speakers to function in different modes (active, motion, or active motion) based on the audio objects (with associated position information) enables the audio reproduction apparatus 102 to achieve enhanced 3D surround sound in the physical 3D space (e.g., the listening area 110) with high accuracy.

The inactive mode may indicate that the speaker is idle (neither producing the sound nor in motion). The operation mode of such speaker may be changed or switched among the active mode, the motion mode, or the active motion mode based on a detection of nearest position information of an audio object in upcoming audio frames. The inactive mode of certain speakers in different audio frames helps the audio reproduction apparatus 102 or a system (including the audio reproduction apparatus 102 and the speakers) to increase overall power efficiency.

Figure 3D:
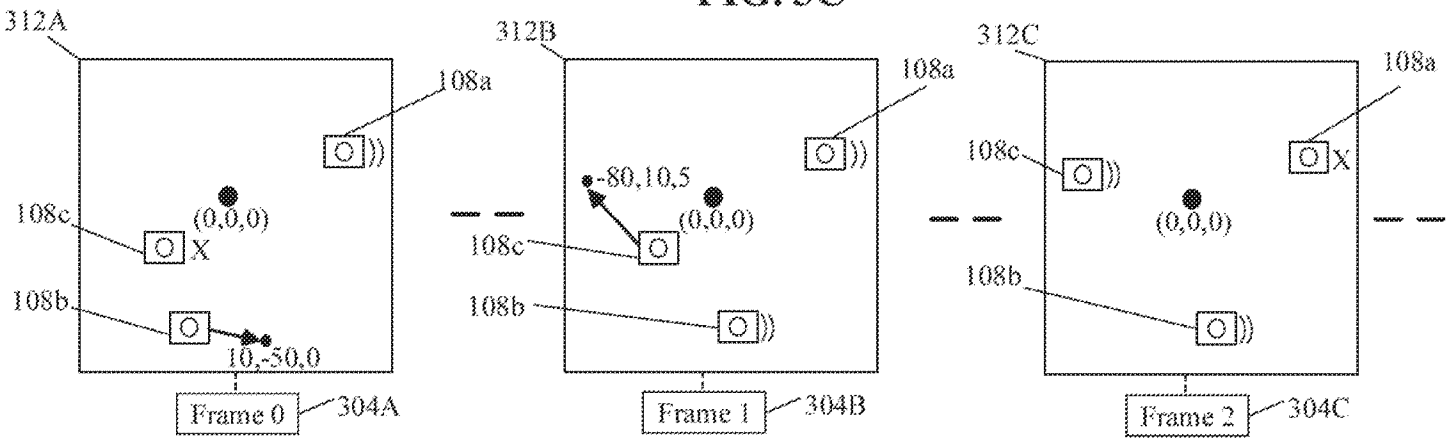

With respect to FIG. 3D, there is shown different modes of the assigned speakers for different audio frames based on the speaker-object mapping information. During the play back of the first frame 312A (also represented as frame 0) of FIG. 3D, the first speaker 108*a* that in the active mode, may reproduce the sound of the first audio object 306A, and may be located at the position information, for example, XYZ coordinates: 100, 20, 80, of the first audio object 306A. Further, during the play back of the first frame 312A (also represented as frame 0), the second speaker 108*b* may be assigned to the second audio object 306B and may be in the motion mode. In accordance with an embodiment, the audio reproduction apparatus 102 may be configured to provide the position information (represented as: 10, −50, 0), of the second audio object 306B to the second speaker 108*b* (or a movable device, of the speaker movement arrangement 216, on which the second speaker 108*b* is mounted) so that the second speaker 108*b* is moved to the provided position information of the second audio object 306B. In some embodiments, the audio reproduction apparatus 102 may be configured to control the second speaker 108*b* to move towards the position information of the second audio object 306B during the reproduction of the first frame 312A (also represented as frame 0). Further, in the first frame 312A (also represented as frame 0), the third speaker 108*c* is in the inactive mode and is not assigned to the audio objects as indicated by the corresponding speaker-output mapping information in FIG. 3C.

During the reproduction of audio associated with the second frame 312B (also represented as frame 1), the first speaker 108*a* may be still in the active mode, and may reproduce the sound of the first audio object 306A and may be located at the same position as that in the first frame 312A (also represented as frame 0). This indicates that the first audio object 306A (e.g. a flying bird) was producing the sound during the reproduction of the audio segment of the first frame 312A (also represented as frame 0) and the second frame 312B (also represented as frame 1). Further, during the reproduction of the audio segment of second frame 312B (also represented as frame 1), the second speaker 108*b* (which moved towards the position of the second audio object 306B in the first frame 312A (also represented as frame 0) may be assigned to the second audio object 306B and may be in the active mode to reproduce the sound of the second audio object 306B. Thus, the second speaker 314B, in order to produce the sound of the second audio object 306B during the play back of the second frame 312B (also represented as frame 1), may position itself to the associated position (of the second object 306B) in advance at the time of the reproduction of the earlier audio frame (the first frame 312A). Therefore, the extraction (pre-decode) of the position information of each audio object in each audio frame and generation of the object-position mapping information and the speaker-object and mapping information before the actual reproduction of the sound, enables the audio reproduction apparatus 102 to automatically identify candidate speakers and operation modes of the speakers for different audio objects in the object-based audio stream. This further enables the audio reproduction apparatus 102 to move the identified speakers to corresponding desired positions of the audio objects before the actual sound reproduction of the audio objects that may be present in the upcoming audio frames.

Further, during the reproduction of the second frame 312B (also represented as frame 1), the third speaker 108*c* may be assigned to the third audio object 306C and may be in the motion mode. Based on the position information, for example, XYZ coordinates: −80, 10, 5, of the third audio object 306C (e.g. a human), the audio reproduction apparatus 102 may be configured to control the third speaker 108*c* to move to the position of the third audio object 306C during play back of the second frame 312B (also represented as frame 1). Further, during the reproduction of the third frame 312C (also represented as frame 2) in FIG. 3D, the first speaker 108*a* may be in the inactive mode and not assigned to an audio object. As shown, the second speaker 108*b* may be still in active mode and may reproduce the sound of the second audio object 306B at the same position. Further, the third speaker 108*c* (which has moved during play back of the second frame 312B) may be in the active mode and reproduce the sound of the third audio object 306C. Therefore, in similar fashion, all the plurality of speakers 108*a* to 108*n* are assigned to different audio objects, and controlled to move (in different XYZ positions) and operate in different operation modes by the audio reproduction apparatus 102 for the reproduction of sound for the entire object-based audio stream. Thus, sound reproduction of each audio object in different 3D positions is achieved with efficient usage of minimum numbers of speakers that have movement capability. In other words, it may not be required to install hundreds of speakers at every possible position in the physical 3D space (i.e. listening area 110) to reproduce same surround sound effect of the audio objects. The minimalistic moving speakers under the control of the audio reproduction apparatus 102 in the physical 3D space (such as the listening area 110) provides precise surround sound reproduction of the audio objects at lesser cost, energy consumption, and computation complexity. Thus, the present disclosure provides several advantages over conventional audio reproduction technologies. It may be further noted that the audio reproduction apparatus 102 may facilitate an optimal utilization of speakers and others resources, and thereby render more computational resources for other operations on the audio reproduction apparatus 102.

Figures 4A, 4B:
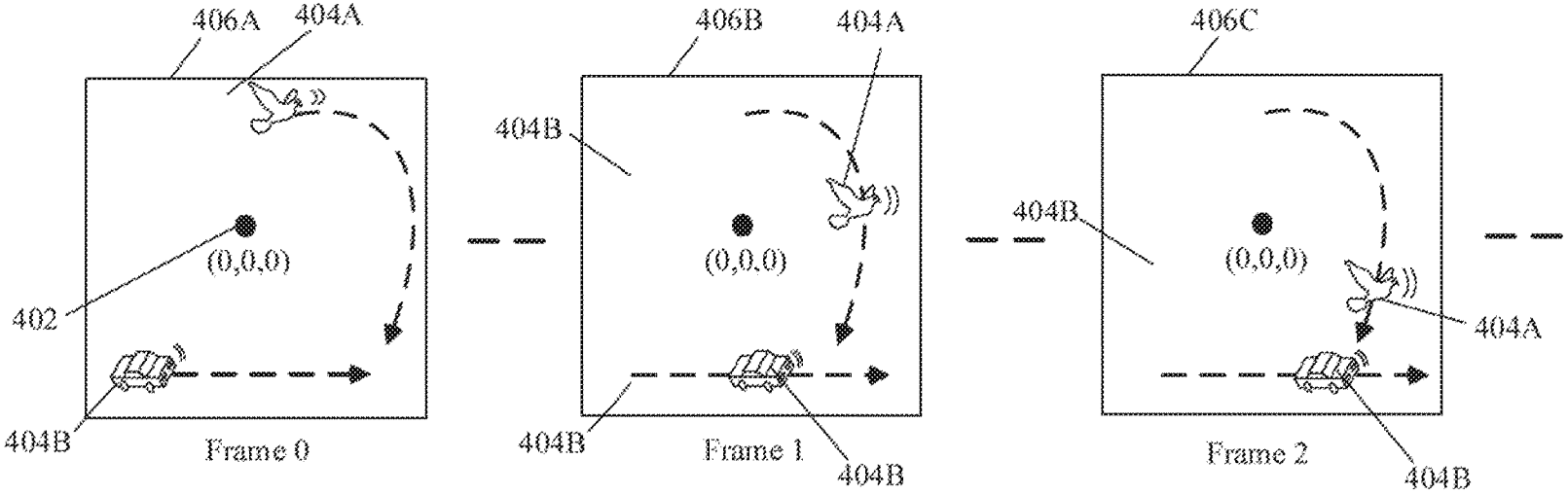
FIG. 4A, FIG. 4B, FIG. 4C, and FIG. 4D, collectively, illustrate exemplary operations for reproducing audio objects, which form a path or a trajectory in consecutive audio frames, by the audio reproduction apparatus of FIG. 2, in accordance with an embodiment of the disclosure.

FIG. 4A, FIG. 4B, FIG. 4C, and FIG. 4D, collectively, illustrate exemplary operations for reproducing audio objects, which forms a path or a trajectory in number of consecutive audio frames, by the audio reproduction apparatus of FIG. 2, in accordance with an embodiment of the disclosure. FIGS. 4A, 4B, 4C, and 4D are explained in conjunction with the elements from FIGS. 1 and 2. In FIG. 4A, the number of consecutive audio frames, such as a first frame 406A, a second frame 406B, and a third frame 406C, illustrate that a first audio object 404A (say as sound from a flying object) forms a trajectory or curve (also represented by a curved and dashed arrow mark) for the consecutive audio frames. Similarly, a second audio object 404B (say as sound of a moving vehicle) forms a linear path (also represented by a straight and dashed arrow mark) for the consecutive audio frames.

In operation, the processor 204 of the audio reproduction apparatus 102 may be configured to extract (i.e., and pre-decode) the position information for the first audio object 404A and the position information for the second audio object 404B for all the audio frames of the encoded object-based audio stream. Further, the object-position map generator 210 may be configured to generate the object-position mapping information 408 that indicates the position information for the first audio object 404A and the second audio object 404B for each of the consecutive audio frames, such as the first frame 406A, the second frame 406B, and the third frame 406C.

With reference to FIG. 4B, there is shown object-position mapping information 408 generated by the object-position map generator 210 for the audio frames 406A, 406B, and 406C in FIG. 4A. In accordance with an embodiment, the processor 204 may be configured to analyze the position information for consecutive audio frames (such as the first frame 406A, the second frame 406B, and the third frame 406C) in the object-position mapping information 408 of the first audio object 404A and the second audio object 404B. The processor 204, based on the analysis, may be further configured to identify whether either of the first audio object 404A or the second audio object 404B follows the trajectory or the curve for the consecutive audio frames 406A, 406B, and 406C. The identification of the trajectory or curve for consecutive audio frames is described in detail, for example, in FIG. 5. As illustrated by FIGS. 4A and 4B, the processor 204 may be configured to identify that the first audio object 404A forms the trajectory and the second audio object 404B forms a linear path for the consecutive audio frames, such as the first frame 406A, the second frame 406B, and the third frame 406C.

Figure 4C:
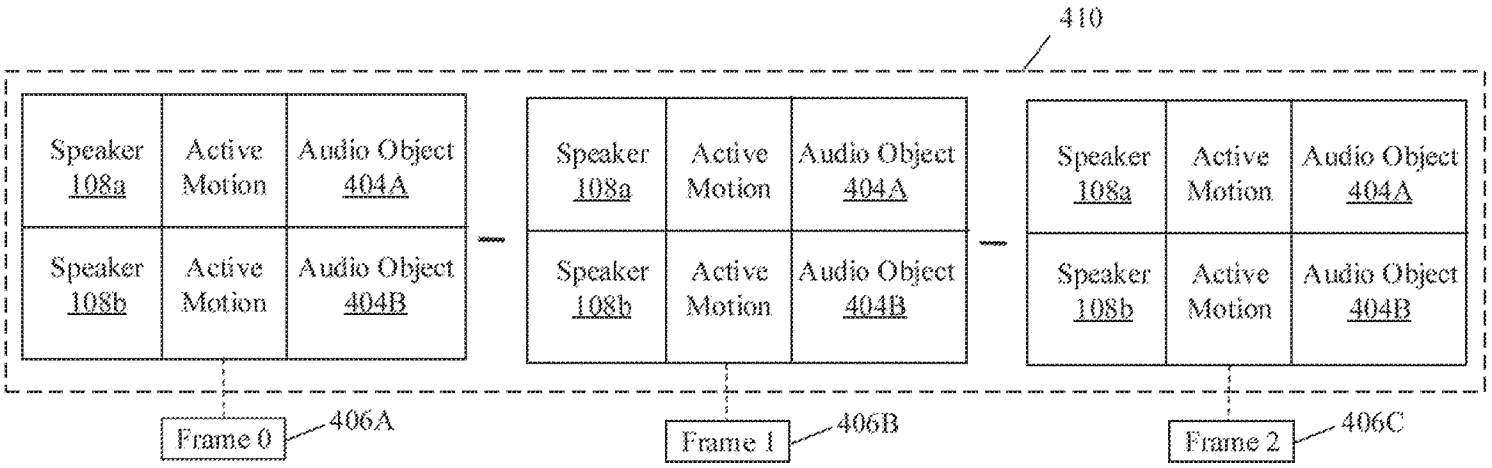

With reference to FIG. 4C, there is shown an exemplary speaker-object mapping information 410 for the first audio object 404A and the second audio object 404B of FIGS. 4A and 4B. The speaker-object map generator 212 may be configured to generate the speaker-object mapping information 410, for the first audio object 404A and the second audio object 404B for each consecutive audio frames, such as the first frame 406A, the second frame 406B, and the third frame 406C. In accordance with the generated speaker-object mapping information 410, the processor 204 may be configured to assign the first speaker 108*a* to the first audio object 404A with the active motion operation mode for the consecutive audio frames, such as the first frame 406A, the second frame 406B, and the third frame 406C. Similarly, in accordance with the generated speaker-object mapping information 410, the processor 204 may be configured to assign a second speaker 108*b* to the second audio object 404B with the active motion operation mode for the consecutive audio frames, such as the first frame 406A, the second frame 406B, and the third frame 406C.

Figure 4D:
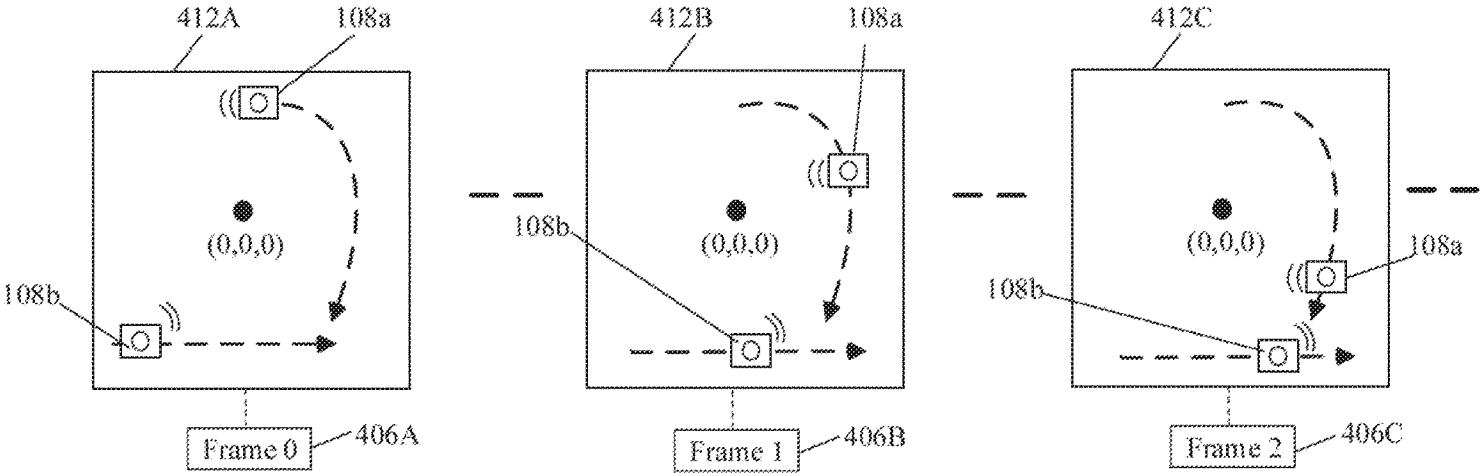

With reference to FIG. 4D, there is shown different representative views 412A, 412B, and 412C. Each of the different representative views 412A, 412B, and 412C is shown associated with one audio frame. For example, the representative view 412A may indicate a current position and an exemplary movement of the first speaker 108*a* along a trajectory and the second speaker 108*b* along a linear path during playback of the first frame 406A. Similarly, the representative views 412B and 412C may indicate a current position and an exemplary movement of the first speaker 108*a* along the trajectory and the second speaker 108*b* along the linear path during playback of the respective consecutive audio frames, such as the second frame 406B and the third frame 406C. The movement of the first speaker 108*a* along the trajectory and the second speaker 108*b* along the linear path may be controlled based on the object-position mapping information 408 and the speaker-object mapping information 410 for each of the consecutive audio frames, such as the first frame 406A, the second frame 406B, and the third frame 406C.

In the active motion mode, the first speaker 108*a* may be configured to produce the sound of the first audio object 404A while moving along the trajectory in accordance with the position information of the first audio object 404A for the consecutive audio frames (i.e., the first frame 406A, the second frame 406B, and the third frame 406C). Similarly, the second speaker 108*b* may be configured to produce the sound of the second audio object 404B while moving along the linear path in accordance with the position information of the second audio object 404B for the consecutive audio frames (i.e., the first frame 406A, the second frame 406B, and the third frame 406C). In accordance with an embodiment, the audio reproduction apparatus 102 may be configured to generate smooth motion of a particular audio object by traversing the speaker 108*a* along the trajectory of the particular audio object.

Figures 5A, 5B:
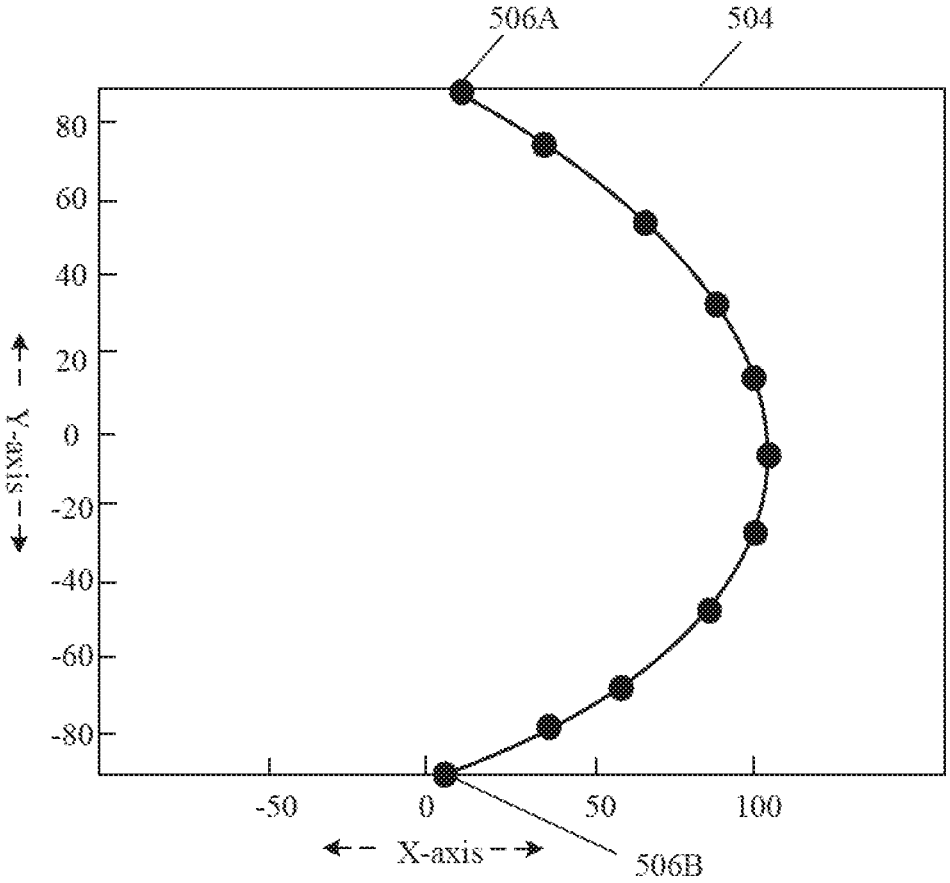
FIG. 5A and FIG. 5B, collectively, illustrate exemplary graphical representation of position information of an audio object which forms the trajectory for the number of consecutive audio frames in the object-based audio stream, in accordance with an embodiment of the disclosure.

FIG. 5A and FIG. 5B, collectively, illustrate exemplary representation of position information of an audio object which forms a trajectory for a number of consecutive audio frames in an object-based audio stream, in accordance with an embodiment of the disclosure. With reference to FIG. 5A, there is shown a representation 502 of object-position mapping information indicating position information (XYZ coordinates) for a specified number of consecutive audio frames for a particular audio object. The representation 502 of the object-position mapping information of the particular audio object may indicate that the particular audio object moved in the trajectory (or curve) on ground level with no change in Z-axis coordinate. In accordance with an embodiment, the processor 204 of the audio reproduction apparatus 102 may be configured to analyze the object-position mapping information to identify that the particular audio object follows the trajectory or curve. In some embodiments, the audio reproduction apparatus 102 may be configured to identify the trajectory based on execution of curve fitting techniques on the position information in the object-position mapping information for the specified number of consecutive audio frames. Examples of the curve fitting techniques may include, but not limited to, are polynomial curve fitting or geometric curve fitting. In accordance with an embodiment, in a case where majority of positions of the particular audio object falls close to the curve, the processor 204 may consider the positions of the particular audio object as part of the curve or the trajectory for the specified number of consecutive audio frames. In accordance with an embodiment, the processor 204 may be configured to define a threshold for the closeness of the positions to the curve based on a size or a total area of the listening area 110.

Figures 6A, 6B, 6C:
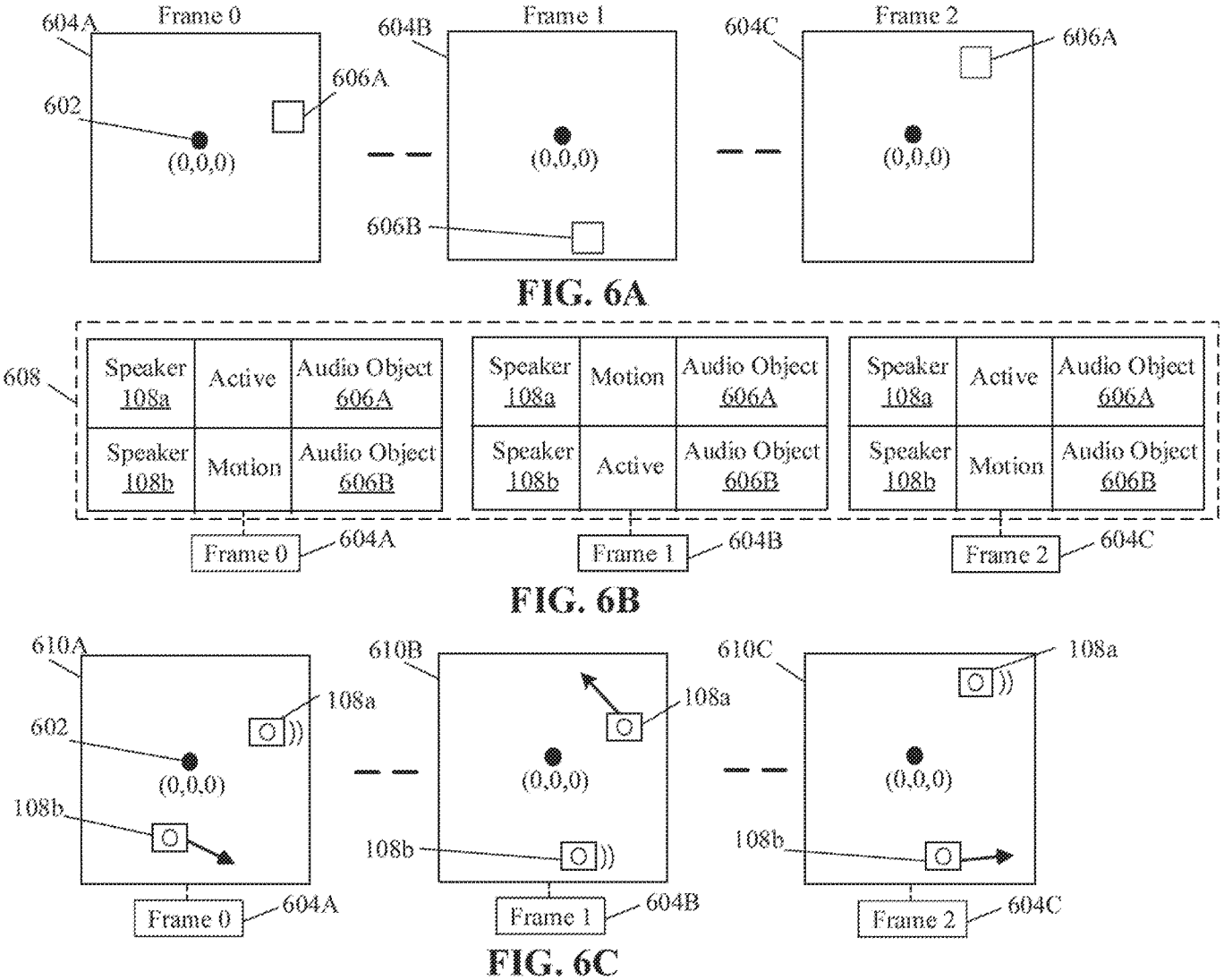
FIG. 6A, FIG. 6B, and FIG. 6C, collectively, illustrate exemplary operations for reproducing audio objects based on a movement of a set of speakers, in accordance with an embodiment of the disclosure.

FIG. 6A, FIG. 6B, and FIG. 6C, collectively, illustrate exemplary operations for reproducing audio objects based on a movement of a set of speakers, in accordance with an embodiment of the disclosure. FIGS. 6A, 6B, and 6C are explained in conjunction with elements from FIGS. 1 and 2. Similar to the operations described with respect to FIGS. 3A to 3D and 4A to 4D, FIGS. 6A, 6B, and 6C, collectively, illustrate the operations of the first speaker 108*a* and the second speaker 108*b*, assigned to a first audio object 606A and a second audio object 606B, respectively, in the ping-pong manner. As shown in FIGS. 6B and 6C, during the play back of a first frame 610A (also represented as frame 0), the first speaker 108*a* may be in the active mode and may produce the sound of the first audio object 606A. Further, during the first frame 610A (also represented as frame 0), a second speaker 108*b* may be in the motion mode and may move towards the position of the second audio object 606B to reproduce the sound of the second audio object 606B in a second frame 610B (also represented as frame 1). Similarly, during the play back of the second frame 610B (also represented as frame 1), the first speaker 108*a* may be in the motion mode and may move towards to a new position of the first audio object 606A to further reproduce the sound of the first audio object 606A in a third frame 610C (also represented as frame 2). Further, during the second frame 610B (also represented as frame 1), the second speaker 108*b* may be in the active mode and may produce the sound of the second audio object 606B in the second frame 6108 (also represented as frame 1).

Such operation, where one speaker reproduces an audio object during one audio frame, and another speaker position itself (during the same audio frame) to further reproduce another audio object during next audio frame, is a ping-pong mode of the audio reproduction apparatus 102. In accordance with an embodiment, the audio reproduction apparatus 102 may be configured to enable the ping-pong mode based on the analysis of the position information of the audio objects in a specified number of consecutive audio frames of the object-based audio stream. In some embodiments, the audio reproduction apparatus 102 may be configured to enable the ping-pong mode based on a number of speakers, with moving capability, in the listening area 110. In some embodiment, the audio reproduction apparatus 102 may be configured to assign multiple sets of speakers in the ping-pong mode. For example, the audio reproduction apparatus 102 may be configured to control a first set of speakers to reproduce an audio object during a current audio frame and control a second set of speakers to move during the current audio frame to further reproduce same or another audio object during next/upcoming audio frame. In accordance with an embodiment, the first or second set of speakers are part of multi-channels speaker systems. Examples of the multi-channels speaker systems may include, but are not limited to, 2.1, 5.1, 7.1, 9.1, 11.1 speaker system arrangements.

In accordance with an embodiment, the processor 204 may be configured to synchronize the movement (in the listening area 110) between the first set of speakers and the second set of speakers to avoid a physical collision between two or more speakers. The processor 204 may be configured to synchronize the movement based on the current position of the speakers stored in the memory 206, destination position to which the speakers have to move, and a path (in the listening area 110) followed by the speakers to move between the current position and the destination position. In accordance with an embodiment, the path followed by the speakers may be based on factors which may include, but are not limited to, current position of other speakers and an existence of listeners in the listening area 110. In some embodiments, one or more speakers of the plurality of speakers 108*a* to 108*n* may be configured to change an angle (or an orientation) before the movement towards the destination position. A particular speaker may be configured to change the angle (or orientation) based on different factors which are, but not limited to, a current angle of orientation of the particular speaker, a position of the listener 112 in the listening area 110, and a direction of the destination position with respect to the current position of the particular speaker. In accordance with an embodiment, a movable device, on which the particular speaker is mounted, may change the angle based on a control signal received from the audio reproduction apparatus 102.

Figure 7:
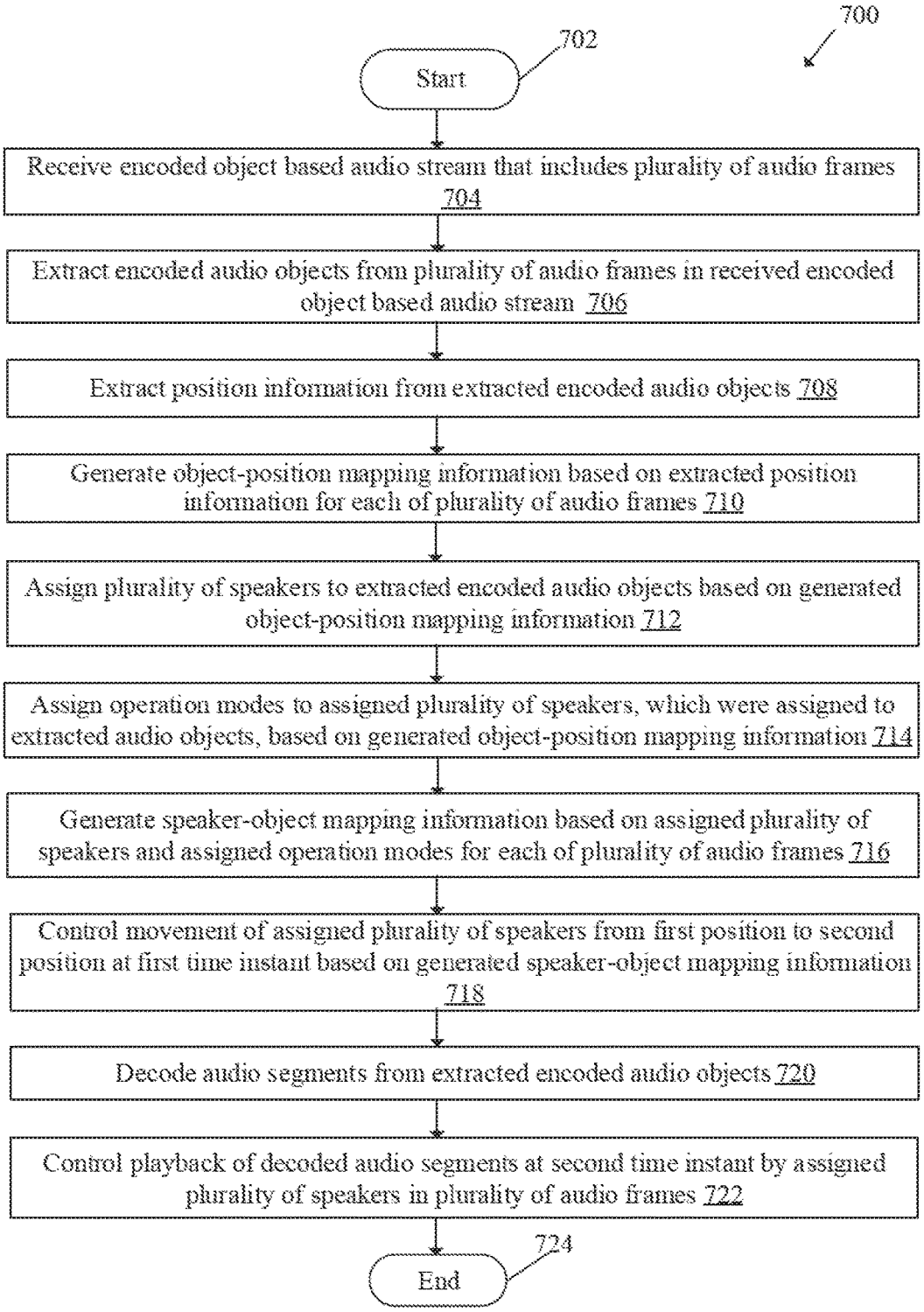
FIG. 7 depicts a first flowchart that illustrates exemplary operations for reproducing audio objects using minimalistic moving speakers, in accordance with an embodiment of the disclosure.

FIG. 7 depicts a flowchart that illustrates exemplary operations for reproducing audio objects using minimalistic moving speakers, in accordance with an embodiment of the disclosure. With reference to FIG. 7 there is shown a flowchart 700. The flowchart 700 is described in conjunction with FIGS. 1, 2, 3A to 3D, and 5A and 5B. The operations from 704 to 722 may be implemented in the audio reproduction apparatus 102. The operations of the flowchart 700 may start at 702 and proceed to 704.

At 704, an encoded object-based audio stream that includes a plurality of audio frames may be received. In accordance with an embodiment, the processor 204 may be configured to receive the encoded object-based audio stream from the multi-media content source 104 via the communication network 106. In some embodiments, the processor 204 of the audio reproduction apparatus 102 may be configured to retrieve the encoded object-based audio stream from the memory 206 of the audio reproduction apparatus 102. The plurality of audio frames may include at least one encoded audio object which includes an audio segment and metadata information associated with the at least one encoded audio object. The metadata information may comprise position information (XYZ coordinates) of the audio object in the physical 3D space (i.e. the listening area 110). The audio segment may comprise sound or audio data of the audio object.

At 706, encoded audio objects may be extracted from the plurality of audio frames in the received encoded object-based audio stream. The processor 204 may be configured to extract the encoded audio objects from the plurality of audio frames in the encoded object-based audio stream.

At 708, the position information (metadata) may be further extracted from the extracted encoded audio objects. The processor 204 may be configured to further extract position information from the extracted encoded audio objects. Alternatively stated, the audio reproduction apparatus 102 may be configured to extract and pre-decode the position information of all the audio objects included in the encoded object-based audio stream before the reproduction of the sound of the audio objects.

At 710, object-position mapping information may be generated based on the extracted position information (metadata) for each of the plurality of audio frames. The object-position map generator 210 of the audio reproduction apparatus 102 may be configured to generate the object-position mapping information for each of the plurality of audio frames. The object-position mapping information may indicate the position information for each audio object in each audio frame included in the encoded object-based audio stream. The audio reproduction apparatus 102 may be configured to determine the position information in advance for each audio object in each audio frame using the generated object-position mapping information. The object-position mapping information is described in detail, for example, in FIGS. 3A to 3D and 4A to 4D.

At 712, a plurality of speakers may be assigned to the extracted encoded audio object based on the generated object-position mapping information. The processor 204 may be configured to select the plurality of speakers and assign the selected plurality of speakers to the one encoded audio objects based on the generated object-position mapping information. In accordance with an embodiment, the processor 204 may select at least one speaker which is nearest, among the plurality of speakers in the physical 3D space (i.e. listening area 110), to the position information of an encoded audio object to which the at least one speaker has to be assigned.

At 714, operation modes may be assigned to the plurality of speakers, which were assigned to the extracted audio objects at 712, based on the generated object-position mapping information. The processor 204 may be configured to assign the operation modes to the plurality of speakers. Examples of the operation modes may include, but are not limited to, active mode (speaker producing sound but not in motion), motion mode (speaker in motion linearly or in trajectory but not producing sound while in motion), active motion mode (speaker producing sound and concurrently moving linearly or in trajectory), inactive mode (speaker in idle, not producing sound, and not in motion). In accordance with an embodiment, the speaker which is not assigned to an audio object during an audio frame may be assigned to the inactive mode.

At 716, speaker-object mapping information may be generated based on the assigned plurality of speakers and the assigned operation modes for each of the plurality of audio frames. The speaker-object map generator 212 of the audio reproduction apparatus 102 may be configured to generate the speaker-object mapping information for each of the plurality of audio frames of the encoded object-based audio stream. The speaker-object mapping information is described in detail, for example, in FIGS. 3A to 3D and 4A to 4D.

At 718, the plurality of speakers assigned to the audio objects may be controlled to move from a first position to a second position at a first time instant based on the generated speaker-object mapping information. The processor 204 may be configured to control the assigned plurality of speakers to move towards the position information of the corresponding audio objects based on the generated speaker-object mapping information. In accordance with an embodiment, the plurality of speakers are controlled to be moved before the reproduction of the sound of the audio objects.

At 720, the audio segments may be decoded and extracted from the encoded audio object. The processor 204 may be configured to extract and decode the audio segments from the encoded audio objects which are assigned to a particular speaker at 712. In accordance with an embodiment, the processor 204 may be configured to decode the audio objects during the corresponding audio frames of the audio objects or prior to the corresponding audio frames of the audio objects.

At 722, play back of the decoded audio segments of the audio objects may be controlled, at a second time instant, by the plurality of speakers assigned to the audio objects at 712. The processor 204 may be configured to control the assigned plurality of speakers (which have already moved to the position of the audio objects at 718) to play back the decoded audio segments during the actual audio frame of the audio objects in the object-based audio stream. The movement of the speakers assigned to the audio objects and reproduction of the sound of the audio objects by the assigned plurality of speakers are shown and described, for example, in FIGS. 3D, 4D and 6C. Control passes to end 724.

Figure 8A:
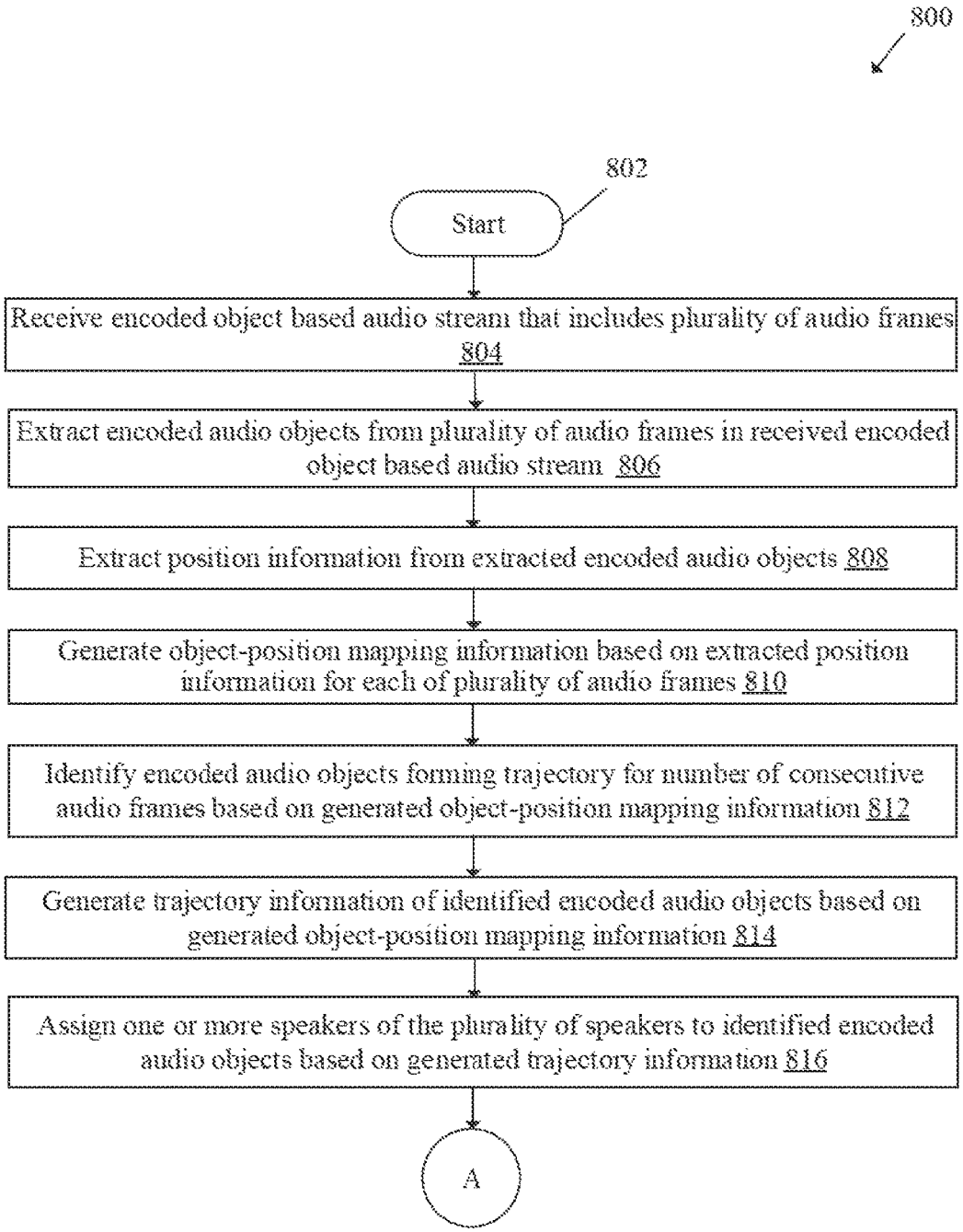
FIG. 8A and FIG. 8B collectively, depict a second flowchart that illustrates exemplary operations for reproducing audio objects which form a path or a trajectory for the number of consecutive audio frames, in accordance with an embodiment of the disclosure.
Figure 8B:
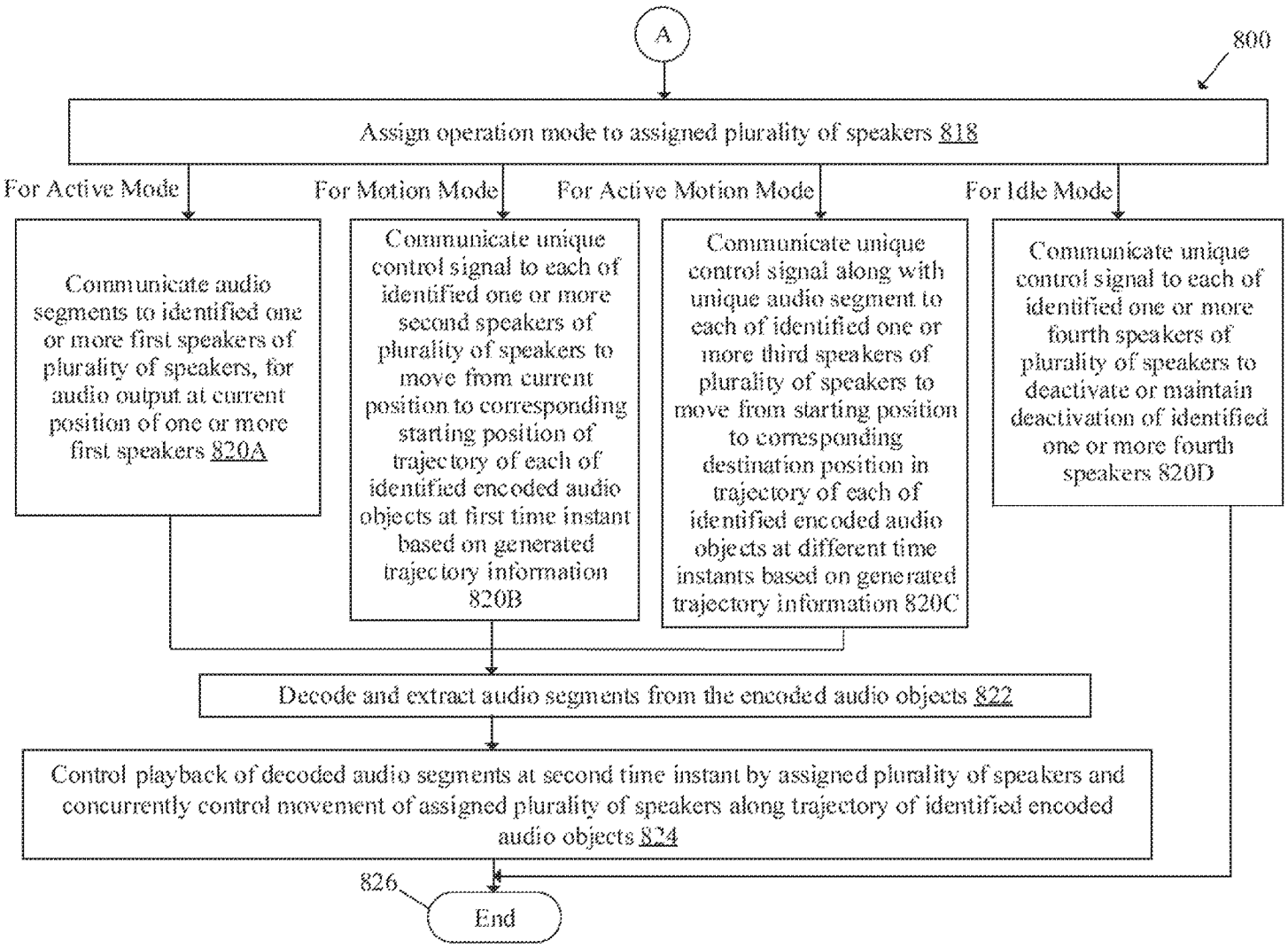

FIG. 8A and FIG. 8B collectively, depict a flowchart that illustrates exemplary operations for reproducing audio objects which form a path or a trajectory in number of consecutive audio frames, in accordance with an embodiment of the disclosure. With reference to FIG. 8A and FIG. 8B, there is shown a flowchart 800. The flowchart 800 is described in conjunction with FIGS. 1, 2, 3A to 3D and 4A to 4D. The operations from 804 to 826 may be implemented in the audio reproduction apparatus 102. The operations of the flowchart 800 may start at 802 and proceed to 804.

The operations 804-810, may be similar to operations of 704-710 of FIG. 7. At 804, an encoded object-based audio stream that includes a plurality of audio frames may be received. At 806, encoded audio objects may be extracted from the plurality of audio frames in the received encoded object-based audio stream. At 808, the position information (metadata) may be further extracted from the extracted encoded audio objects. At 810, object-position mapping information may be generated based on the extracted position information (metadata) for each of the plurality of audio frames.

At 812, the encoded audio objects that form a trajectory for a number of consecutive audio frames may be identified based on the generated object-position mapping information. The processor 204 may be configured to identify the audio objects, which form the trajectory or curve for specified number of consecutive audio frames, based on the position information of the audio objects in the generated object-position mapping information. In accordance with an embodiment, the processor 204 may be configured to analyze the position information of the audio objects for the specified number of consecutive audio frames and identify the audio objects which form the trajectory based on the analysis. The details of the identification of the audio objects which form the trajectory are described in detail, for example, in FIG. 5.

At 814, trajectory information of the identified audio objects may be generated based on the generated object-position mapping information. The processor 204 may be configured to generate the trajectory information of the identified audio objects and store the generated trajectory information in the memory 206. The trajectory information may include the position information of the identified audio objects for the number of consecutive audio frames. In accordance with an embodiment, the trajectory information may include change in position information (XYZ coordinates) between the number of consecutive audio frames. The change in the position information may be in either of the X-axis coordinate, the Y-axis coordinate, or the Z-axis coordinate in the physical 3D space (i.e. listening area).

At 816, one or more speakers of the plurality of speakers 108*a* to 108*n* may be assigned to the identified encoded audio objects based on the generated trajectory information. The processor 204 may be configured to select a speaker from the plurality of speakers 108*a* to 108*n* and assign the selected speaker to the identified audio object. In accordance with an embodiment, the processor 204 may select the speaker which is nearest, among the plurality of speakers 108*a* to 108*n*, and position the selected speaker to a starting position of the trajectory information of the identified audio object. In some embodiments, the processor 204 may select the speaker which is currently in the inactive mode (speaker neither producing sound nor in motion).

At 818, an operation mode may be assigned to the plurality of speakers 108*a* to 108*n*. The processor 204 may be configured to assign an operation mode to the assigned plurality of speakers. Examples of the operation mode include, but are not limited to, an active mode (speaker producing sound but not in motion), a motion mode (speaker in motion either linearly or in trajectory but not producing sound while in motion), an active motion mode (speaker producing sound as well as in motion), and an inactive mode (speaker is idle, not producing sound, and not in motion). In cases where an active mode is assigned, the control moves to 820A. In cases where the motion mode is assigned, the control moves to 820B. In cases where active motion mode is assigned, the control moves to 820C. In cases where the inactive mode is assigned, the control moves to 820D.

At 820A, audio segments may be communicated to identified one or more first speakers of the plurality of speakers 108*a* to 108*n*, for audio output at the current position of the one or more first speakers. At 820B, a unique control signal may be communicated to each of the identified one or more second speakers of the plurality of speakers 108*a* to 108*n* to move from a current position to a corresponding starting position of the trajectory of each of the identified encoded audio objects at a first time instant based on the generated trajectory information. The unique control signal may include position information for a particular speaker. The processor 204 may be configured to disable audio output from the identified one or more second speakers while the identified one or more second speakers are moved in the motion mode. The identified one or more second speakers are positioned at different starting positions before the actual reproduction of respective audio objects which forms the trajectory for the specified number of the consecutive audio frames. At 820C, a unique control signal along with a unique audio segment may be communicated to each of the identified one or more third speakers of the plurality of speakers 108*a* to 108*n* to move from a starting position to a corresponding destination position in the trajectory of each of the identified encoded audio objects at different time instants based on the generated trajectory information. In the active motion mode, the identified one or more third speakers of the plurality of speakers 108*a* to 108*n*, may concurrently produce the sound of the audio objects while moving along the trajectory for the specified number of consecutive audio frames of the audio objects. At 820D, a unique control signal may be communicated to each of the identified one or more fourth speakers of the plurality of speakers 108*a* to 108*n* to deactivate or maintain deactivation of the identified one or more fourth speaker. Deactivation of both the sound output and motion is maintained.

At 822, the audio segments may be decoded and extracted from the encoded audio objects. The processor 204 may be configured to decode and extract the audio segments (sound data) from the audio objects which forms the trajectory. In accordance with an embodiment, the processor 204 may be configured to decode the audio segments during the play back of corresponding audio frames of the audio objects or prior to the play back of corresponding audio frames of the audio objects which forms the trajectory for the number of consecutive audio frames.

At 824, play back of the decoded audio segments of the audio objects may be controlled, at a second time instant, and movement of the identified one or more speakers may be concurrently controlled along the trajectory (except for active mode) of the identified encoded audio objects. The processor 204 may be configured to control the identified one or more speakers of the assigned plurality of speakers (which have already moved to the starting position of the trajectory at 820) to play back the decoded audio segments during the actual audio frames of the audio object. The processor 204 may be further configured to control the movement of the identified one or more speakers of the plurality of speakers 108*a* to 108*n* to move along the trajectory of the audio objects while reproducing the audio segments of the respective audio objects. The trajectory movement of the one or more speakers and reproduction of the sound of the audio objects has been shown and described, for example, in FIGS. 6A to 6C. Control passes to end 826.

In accordance with exemplary aspect of the disclosure, the audio reproduction apparatus 102 may be a head-mounted device (HMD). Thus, the operations executed by the audio reproduction apparatus 102 as described in the present disclosure, may also be executed by the HMD. For example, the HMD may be coupled to the plurality of speakers which are positioned around a head of a user wearing the HMD. In accordance with an embodiment, the plurality of speakers, coupled to the HMD, are small-sized speakers (e.g. tiny button like speakers) as compared to desktop speakers, which may move in 360 degree directions around the head of the user and may provide the surround sound effect to the user based on the audio objects reproduced by the HMD.

Exemplary aspects of the disclosure may include an audio reproduction apparatus (such as the audio reproduction apparatus 102) that includes circuitry (such as the circuitry 200) and a memory (such as the memory 206). The memory may be configured to store an encoded object-based audio stream that includes a plurality of audio frames. The plurality of audio frames comprises at least one encoded audio object that comprises an audio segment and metadata information associated with the at least one encoded audio object. The circuitry may be configured to extract the metadata information, associated with the at least one encoded audio object, from the plurality of audio frames in the encoded object-based audio stream. The circuitry may be further configured to control movement of a first speaker of a plurality of speakers in a physical three dimensional (3D) space, based on the extracted metadata information associated with the at least one encoded audio object. The circuitry may be further configured to control the movement of the first speaker from a first position to a second position in the physical 3D space at a first time instant. The circuitry may be further configured to decode the audio segment from the at least one encoded audio object in the plurality of audio frames. The circuitry may be further configured to control play back of the decoded audio segment by the first speaker at the second position in a first audio frame of the plurality of audio frames. The circuitry may be further configured to control play back of the decoded audio segment at a second time instant which is after the first time instant (at which the first speaker moved).

In accordance with an embodiment, the metadata information may include position information associated with the at least one encoded audio object. The position information may include a X-axis coordinate, a Y-axis coordinate, and a Z-axis coordinate in the physical 3D space. The circuitry may be further configured to move the first speaker of the plurality of speakers to the second position, based on at least one of the X-axis coordinate, the Y-axis coordinate, or the Z-axis coordinate of the position information.

In accordance with an embodiment, the circuitry may be further configured to select the first speaker from the plurality of speakers based on the position information associated with the at least one encoded audio object. The first speaker is nearest, among the plurality of speakers, in the physical 3D space to the position information associated with the at least one encoded audio object.

In accordance with an embodiment, the circuitry may be further configured to generate object-position mapping information for the plurality of audio frames. The object-position mapping information may indicate the position information of a plurality of encoded audio objects which include the at least one encoded audio object in the plurality of audio frames. The circuitry may be further configured to generate speaker-object mapping information for each of the plurality of audio frames based on the generated object-position mapping information. The speaker-object mapping information may indicate at least one of movement information or an operation mode of the plurality of speakers associated with the plurality of encoded audio objects. The circuitry may be further configured to change the operation mode of the plurality of speakers in different audio frames of the encoded object-based audio stream, based on the corresponding metadata information of the plurality of encoded audio objects in the different audio frames.

In accordance with an embodiment, the operation mode may include at least one of an active mode, a motion mode, an active motion mode, or an inactive mode. In the active mode, the circuitry may be further configured to control the first speaker to play back the decoded audio segment. In the motion mode, the circuitry may be further configured to control the movement of the first speaker based on the position information associated with the at least one encoded audio object and disable the first speaker to play back the decoded audio segment. In the active motion mode, the circuitry may be further configured to control the first speaker to move based on the position information and concurrently play back the decoded audio segment. In the inactive mode, the circuitry may be further configured to disable the first speaker to move and play back the decoded audio segment.

In accordance with an embodiment, the circuitry may be further configured to extract the position information, associated with the at least one encoded audio object, from a number of consecutive audio frames in the encoded object-based audio stream. The circuitry may be further configured to determine whether the position information associated with the at least one encoded audio object forms a path or a trajectory for the number of consecutive audio frames. The circuitry may be further configured to control the movement of the first speaker along the path or the trajectory based on the determination that the position information associated with the at least one encoded audio object forms the path or the trajectory for the number of consecutive audio frames.

In accordance with an embodiment, the circuitry may be further configured to control the movement of the first speaker in a second audio frame of the plurality of audio frames. The second audio frame may be present before the first audio frame in the encoded object-based audio stream. The circuitry may be further configured to control movement of a second speaker of the plurality of speakers, in the first audio frame, based on the metadata information associated with a second encoded audio object in the encoded object-based audio stream. The circuitry may be further configured to control the movement of the second speaker from a third position to a fourth position in the physical 3D space. The circuitry may be further configured to control play back of a second audio segment of the second encoded audio object by the second speaker at the fourth position in a third audio frame of the plurality of audio frames. The circuitry may be further configured to control the play back of the second audio segment at a third time instant which is after the second time instant. The circuitry may be further configured to synchronize the movement between the first speaker and the second speaker to avoid a collision between the first speaker and the second speaker in the physical 3D space.

In accordance with an embodiment, each of the plurality of speakers may be mounted on a moveable device in a speaker movement arrangement, wherein the moveable device may include one of a flying object, a device with moveable arms or a device with a capability of 360-degree movement in the physical 3D space.

Various embodiments of the disclosure may provide a non-transitory, computer-readable medium and/or storage medium, and/or a non-transitory machine readable medium and/or storage medium stored thereon, a set of instructions executable by a machine and/or a computer that comprises control circuitry. The set of instructions may be executable by the machine and/or the computer to perform the steps that comprise the storage of an encoded object-based audio stream that includes a plurality of audio frames. The plurality of audio frames comprises at least one encoded audio object that comprises an audio segment and metadata information associated with the at least one encoded audio object. The metadata information, associated with the at least one encoded audio object, may be extracted from the plurality of audio frames in the encoded object-based audio stream. The movement of a first speaker of a plurality of speakers may be controlled in a physical three dimensional (3D) space from a first position to a second position at a first time instant, based on the extracted metadata information associated with the at least one encoded audio object. The audio segment may be decoded from the at least one encoded audio object in the plurality of audio frames. The play back of the decoded audio segment may be controlled at a second time instant which is after the first time instant, by the first speaker at the second position in a first audio frame of the plurality of audio frames.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted to carry out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features that enable the implementation of the methods described herein, and which when loaded in a computer system is able to carry out these methods. Computer program, in the present context, means any expression, in any language, code or notation, of a set of instructions intended to cause a system with information processing capability to perform a particular function either directly, or after either or both of the following: a) conversion to another language, code or notation; b) reproduction in a different material form.

While the present disclosure is described with reference to certain embodiments, it will be understood by those skilled in the art that various changes may be made and equivalents may be substituted without departure from the scope of the present disclosure. In addition, many modifications may be made to adapt a particular situation or material to the teachings of the present disclosure without departure from its scope. Therefore, it is intended that the present disclosure not be limited to the particular embodiment disclosed, but that the present disclosure will include all embodiments that fall within the scope of the appended claims.

What is claimed is:

1. An audio reproduction apparatus, comprising:

a memory configured to store an encoded object-based audio stream that includes a plurality of audio frames, wherein the plurality of audio frames comprises at least one encoded audio object that comprises an audio segment and metadata information associated with the at least one encoded audio object; and circuitry, coupled to the memory, configured to:

extract the metadata information, associated with the at least one encoded audio object, from the plurality of audio frames in the encoded object-based audio stream;

select a first speaker from a plurality of speakers in a physical three dimensional (3D) space based on the extracted metadata information, wherein the extracted metadata information comprises position information associated with the at least one encoded audio object, and the selected first speaker is nearest, among the plurality of speakers in the physical 3D space, to the position information associated with the at least one encoded audio object;

control movement of the selected first speaker in the physical 3D space from a first position to a second position, based on the extracted metadata information;

decode the audio segment from the at least one encoded audio object in the plurality of audio frames; and control play back of the decoded audio segment by the selected first speaker at the second position.

2. The audio reproduction apparatus according to claim 1, wherein the position information comprises a x-axis coordinate, a y-axis coordinate, and a z-axis coordinate in the physical 3D space.

3. The audio reproduction apparatus according to claim 2, wherein the circuitry is further configured to control the movement of the selected first speaker of the plurality of speakers to the second position, based on at least one of the x-axis coordinate, the y-axis coordinate, or the z-axis coordinate of the position information.

4. The audio reproduction apparatus according to claim 1, wherein the circuitry is further configured to generate object-position mapping information for the plurality of audio frames, the object-position mapping information indicates position information of a plurality of encoded audio objects, and the plurality of encoded audio objects includes the at least one encoded audio object in the plurality of audio frames.

5. The audio reproduction apparatus according to claim 4, wherein the circuitry is further configured to:

generate speaker-object mapping information for each of the plurality of audio frames based on the generated object-position mapping information, wherein the speaker-object mapping information indicates at least one of movement information or an operation mode of the plurality of speakers associated with the plurality of encoded audio objects.

6. The audio reproduction apparatus according to claim 5, wherein the circuitry is further configured to change the operation mode of the plurality of speakers in different audio frames in the encoded object-based audio stream, based on a corresponding metadata information of the plurality of encoded audio objects in the different audio frames.

7. The audio reproduction apparatus according to claim 6, wherein the operation mode comprises at least one of an active mode, a motion mode, an active motion mode, or an inactive mode.

8. The audio reproduction apparatus according to claim 7, wherein, in the active mode, the circuitry is further configured to control the selected first speaker to play back the decoded audio segment.

9. The audio reproduction apparatus according to claim 7, wherein, in the motion mode, the circuitry is further configured to:

control the movement of the selected first speaker based on the position information associated with the at least one encoded audio object; and disable the selected first speaker to play back the decoded audio segment.

10. The audio reproduction apparatus according to claim 7, wherein, in the active motion mode, the circuitry is further configured to:

control the movement of the selected first speaker based on the position information; and concurrently play back the decoded audio segment.

11. The audio reproduction apparatus according to claim 7, wherein, in the inactive mode, the circuitry is further configured to:

disable the movement of the selected first speaker; and disable the play back of the decoded audio segment.

12. The audio reproduction apparatus according to claim 1, wherein the circuitry is further configured to:

extract the position information from a set of consecutive audio frames of the plurality of audio frames in the encoded object-based audio stream;

determine whether the extracted position information corresponds to one of a path for the set of consecutive audio frames or a trajectory for the set of consecutive audio frames; and control the movement of the selected first speaker along one of the path or the trajectory based on the determination that the extracted position information corresponds to one of the path or the trajectory.

13. The audio reproduction apparatus according to claim 1, wherein the circuitry is further configured to:

control the play back of the decoded audio segment by the selected first speaker at the second position, wherein the decoded audio segment is in a first audio frame of the plurality of audio frames; and control the movement of the selected first speaker during playback of a second audio frame of the plurality of audio frames, wherein the second audio frame is before the first audio frame in the encoded object-based audio stream.

14. The audio reproduction apparatus according to claim 13, wherein the circuitry is further configured to:

control movement of a second speaker of the plurality of speakers from a third position to a fourth position in the physical 3D space, based on the metadata information associated with a second encoded audio object in the encoded object-based audio stream; and control play back of a different audio segment of the second encoded audio object by the second speaker at the fourth position, wherein the different audio segment is in a third audio frame of the plurality of audio frames.

15. The audio reproduction apparatus according to claim 14, wherein the circuitry is further configured to synchronize the movement between the selected first speaker and the second speaker to avoid a collision between the selected first speaker and the second speaker in the physical 3D space.

16. The audio reproduction apparatus according to claim 1, wherein each of the plurality of speakers is mounted on a movable device in a speaker movement arrangement, and the movable device comprises one of a flying object, a device with movable arms or a device with a capability of 360-degree movement in the physical 3D space.

17. An audio reproduction method, comprising:

in an audio reproduction apparatus that includes a memory and control circuitry:

storing, in the memory, an encoded object-based audio stream that includes a plurality of audio frames, wherein the plurality of audio frames comprises at least one encoded audio object that comprises an audio segment and metadata information associated with the at least one encoded audio object;

extracting, by the control circuitry, the metadata information, associated with the at least one encoded audio object, from the plurality of audio frames in the encoded object-based audio stream;

selecting, by the control circuitry, a first speaker from a plurality of speakers in a physical three dimensional (3D) space based on the extracted metadata information, wherein the extracted metadata information comprises position information associated with the at least one encoded audio object, and the selected first speaker is nearest, among the plurality of speakers in the physical 3D space, to the position information associated with the at least one encoded audio object;

controlling, by the control circuitry, movement of the selected first speaker in the physical 3D space from a first position to a second position, based on the extracted metadata information;

decoding, by the control circuitry, the audio segment from the at least one encoded audio object in the plurality of audio frames; and controlling, by the control circuitry, play back of the decoded audio segment by the selected first speaker at the second position.

18. The audio reproduction method according to claim 17, wherein the position information comprises a x-axis coordinate, a y-axis coordinate, and a z-axis coordinate in the physical 3D space.

19. The audio reproduction method according to claim 18, further comprising controlling, by the circuitry, movement of the selected first speaker of to the second position, based on at least one of the x-axis coordinate, the y-axis coordinate, or the z-axis coordinate in the position information.

20. A non-transitory computer-readable medium having stored thereon computer implemented instructions that, when executed by an audio reproduction apparatus, causes the audio reproduction apparatus to execute operations, the operations comprising:

storing an encoded object-based audio stream that includes a plurality of audio frames, wherein the plurality of audio frames comprises at least one encoded audio object that comprises an audio segment and metadata information associated with the at least one encoded audio object;

extracting the metadata information, associated with the at least one encoded audio object, from the plurality of audio frames in the encoded object-based audio stream;

selecting a first speaker from a plurality of speakers in a physical three dimensional (3D) space based on the extracted metadata information, wherein the extracted metadata information comprises position information associated with the at least one encoded audio object, and the selected first speaker is nearest, among the plurality of speakers in the physical 3D space, to the position information associated with the at least one encoded audio object;

controlling movement of the selected first speaker in the physical 3D space from a first position to a second position, based on the extracted metadata information;

decoding the audio segment from the at least one encoded audio object in the plurality of audio frames; and controlling play back of the decoded audio segment by the selected first speaker at the second position.

* * * * *